US010388206B2

(12) United States Patent
Guo et al.

(10) Patent No.: US 10,388,206 B2
(45) Date of Patent: Aug. 20, 2019

(54) PIXEL ARRAY, DRIVING METHOD THEREOF, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/679,290

(22) Filed: Aug. 17, 2017

(65) Prior Publication Data

US 2018/0018912 A1 Jan. 18, 2018

Related U.S. Application Data

(63) Continuation of application No. 14/415,947, filed as application No. PCT/CN2014/081205 on Jun. 30, 2014, now Pat. No. 9,773,445.

(30) Foreign Application Priority Data

Dec. 30, 2013 (CN) ..... 2013 1 0743230

(51) Int. Cl.
*G09G 3/20* (2006.01)

(52) U.S. Cl.
CPC ..... *G09G 3/2074* (2013.01); *G09G 3/2003* (2013.01); *G09G 2300/0426* (2013.01);
(Continued)

(58) Field of Classification Search
CPC ..... G09G 3/2003; G09G 3/2074; G09G 2340/0457; G09G 2320/0666;
(Continued)

(56) References Cited

U.S. PATENT DOCUMENTS

| | | | |
|---|---|---|---|
| 7,102,655 | B2 | 9/2006 | Toji et al. |
| 2003/0095135 | A1 | 5/2003 | Kaasila et al. |

(Continued)

FOREIGN PATENT DOCUMENTS

| | | | |
|---|---|---|---|
| CN | 1549240 | A | 11/2004 |
| CN | 1779510 | A | 5/2006 |
| CN | 103714775 | A | 4/2014 |

OTHER PUBLICATIONS

First Office Action and its English translation of CN Application No. 201310743230.2 dated Aug. 18, 2015.

(Continued)

*Primary Examiner* — Christopher E Leiby
(74) *Attorney, Agent, or Firm* — Nath, Goldberg & Meyer; Joshua B. Goldberg; Stanley N. Protigal

(57) ABSTRACT

The present invention provides a pixel array comprising a plurality of pixel units, each of which comprises three sub-pixels in different colors, wherein, in each pixel unit, any two adjacent sub-pixels are combined into a pixel block. Compared to the prior art, the width of the sub-pixel in the present invention increases, which reduces the difficulty of the manufacturing process of the pixel array and improves product yield. The present invention further provides a driving method of the pixel array, a display panel including the pixel array, and a display device including the display panel. When driving the above pixel array with the driving method, granular sensation of the display panel including (Continued)

the pixel array can be reduced, and a display effect of a display panel with higher resolution in the same size can be achieved.

1 Claim, 10 Drawing Sheets

(52) U.S. Cl.
CPC . *G09G 2300/0452* (2013.01); *G09G 2300/08* (2013.01); *G09G 2320/0666* (2013.01); *G09G 2340/0457* (2013.01)

(58) Field of Classification Search
CPC ..... G09G 2300/0452; G09G 2300/08; G09G 2300/0426
See application file for complete search history.

(56) References Cited

U.S. PATENT DOCUMENTS

2004/0150651 A1 8/2004 Phan
2005/0008258 A1 1/2005 Suzuki et al.
2005/0062767 A1 3/2005 Choe et al.
2005/0151752 A1 7/2005 Phan
2006/0103615 A1 5/2006 Shih et al.
2006/0158466 A1 7/2006 Chien
2006/0221030 A1 10/2006 Shih et al.
2008/0238840 A1 10/2008 Raman et al.
2010/0045695 A1 2/2010 Brown Elliott et al.
2010/0290710 A1* 11/2010 Gagvani ..... G06K 9/00543 382/224
2011/0273494 A1 11/2011 Jun
2012/0262475 A1 10/2012 Frank et al.
2013/0241946 A1 9/2013 Jeong et al.
2013/0300772 A1 11/2013 Kim
2015/0030247 A1* 1/2015 Shu ..... H04N 1/58 382/167
2015/0243251 A1 8/2015 Ohnishi
2015/0253476 A1 9/2015 Shao et al.

OTHER PUBLICATIONS

English translation of the Written Opinion of the International Searching Authority (i.e. Box No. V of Form PCT/ISA/237) of PCT/CN2014/081205.
International Search Report for International Application No. PCT/CN2014/081205.

* cited by examiner $$
(1)\ \begin{array}{c|ccc} & S7 & S10 & S13 \\ \hline G2 & -0.02; & 0; & -0.02; \\ G3 & 0; & 0.08; & 0; \\ G4 & -0.02; & 0; & -0.02; \end{array}
\quad
(2)\ \begin{array}{c|ccc} & S7 & S10 & S13 \\ \hline G2 & -0.03; & 0; & -0.03; \\ G3 & 0; & 0.12; & 0; \\ G4 & -0.03; & 0; & -0.03; \end{array}
\quad
(3)\ \begin{array}{c|ccc} & S7 & S10 & S13 \\ \hline G2 & -0.04; & 0; & -0.04; \\ G3 & 0; & 0.16; & 0; \\ G4 & -0.04; & 0; & -0.04; \end{array}
$$

$$
(4)\ \begin{array}{c|ccc} & & & \\ \hline G2 & -0.05; & 0; & -0.05; \\ G3 & 0; & 0.2; & 0; \\ G4 & -0.05; & 0; & -0.05; \end{array}
\quad
(5)\ \begin{array}{c|ccc} & & & \\ \hline G2 & -0.06; & 0; & -0.06; \\ G3 & 0; & 0.24; & 0; \\ G4 & -0.06; & 0; & -0.06; \end{array}
\quad
(6)\ \begin{array}{c|ccc} & & & \\ \hline G2 & -0.07; & 0; & -0.07; \\ G3 & 0; & 0.28; & 0; \\ G4 & -0.07; & 0; & -0.07; \end{array}
$$

$$
(7)\ \begin{array}{c|ccc} & & & \\ \hline G2 & -0.08; & 0; & -0.08; \\ G3 & 0; & 0.32; & 0; \\ G4 & -0.08; & 0; & -0.08; \end{array}
\quad
(8)\ \begin{array}{c|ccc} & & & \\ \hline G2 & -0.09; & 0; & -0.09; \\ G3 & 0; & 0.36; & 0; \\ G4 & -0.09; & 0; & -0.09; \end{array}
\quad
(9)\ \begin{array}{c|ccc} & & & \\ \hline G2 & -0.1; & 0; & -0.1; \\ G3 & 0; & 0.4; & 0; \\ G4 & -0.1; & 0; & -0.1; \end{array}
$$

Fig. 3

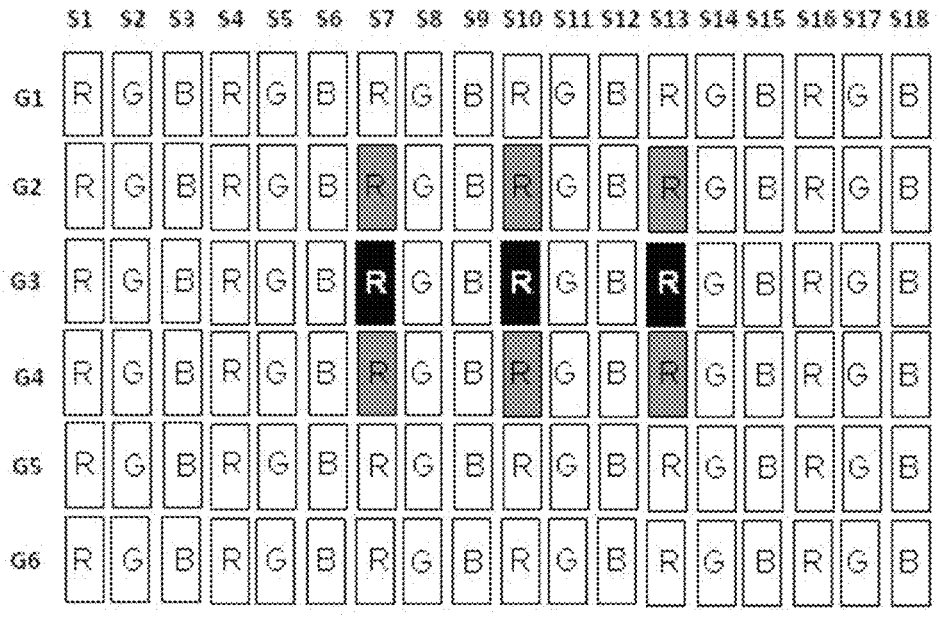

Fig. 4

(1)
$$\begin{pmatrix} -0.02; & -0.02; & -0.02; \\ 0; & 0.12; & 0; \\ -0.02; & -0.02; & -0.02; \end{pmatrix}$$

(2)
$$\begin{pmatrix} -0.03; & -0.03; & -0.03; \\ 0; & 0.18; & 0; \\ -0.03; & -0.03; & -0.03; \end{pmatrix}$$

(3)
$$\begin{pmatrix} -0.04; & -0.04; & -0.04; \\ 0; & 0.24; & 0; \\ -0.04; & -0.04; & -0.04; \end{pmatrix}$$

(4)
$$\begin{pmatrix} -0.05; & -0.05; & -0.05; \\ 0; & 0.3; & 0; \\ -0.05; & -0.05; & -0.05; \end{pmatrix}$$

(5)
$$\begin{pmatrix} -0.06; & -0.06; & -0.06; \\ 0; & 0.36; & 0; \\ -0.06; & -0.06; & -0.06; \end{pmatrix}$$

(6)
$$\begin{pmatrix} -0.02; & -0.06; & -0.02; \\ 0; & 0.18; & 0; \\ -0.02; & -0.06; & -0.02; \end{pmatrix}$$

(7)
$$\begin{pmatrix} -0.02; & -0.06; & -0.02; \\ 0; & 0.2; & 0; \\ -0.02; & -0.06; & -0.02; \end{pmatrix}$$

(8)
$$\begin{pmatrix} -0.02; & -0.1; & -0.02; \\ 0; & 0.28; & 0; \\ -0.02; & -0.1; & -0.02; \end{pmatrix}$$

(9)
$$\begin{pmatrix} -0.05; & -0.1; & -0.05; \\ 0; & 0.4; & 0; \\ -0.05; & -0.1; & -0.05; \end{pmatrix}$$

Fig. 5

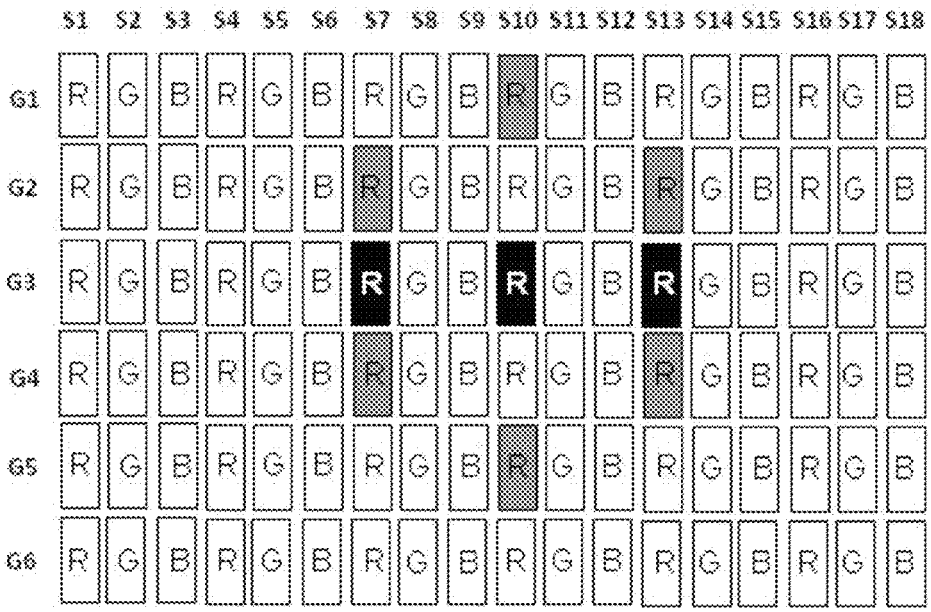

Fig. 6

(1)
$$\begin{pmatrix} 0; & -0.02; & 0; \\ -0.02; & 0; & -0.02; \\ 0; & 0.12; & 0; \\ -0.02; & 0; & -0.02; \\ 0; & -0.02; & 0; \end{pmatrix}$$

(2)
$$\begin{pmatrix} 0; & -0.03; & 0; \\ -0.03; & 0; & -0.03; \\ 0; & 0.18; & 0; \\ -0.03; & 0; & -0.03; \\ 0; & -0.03; & 0; \end{pmatrix}$$

(3)
$$\begin{pmatrix} 0; & -0.04; & 0; \\ -0.04; & 0; & -0.04; \\ 0; & 0.24; & 0; \\ -0.04; & 0; & -0.04; \\ 0; & -0.04; & 0; \end{pmatrix}$$

(4)
$$\begin{pmatrix} 0; & -0.05; & 0; \\ -0.05; & 0; & -0.05; \\ 0; & 0.3; & 0; \\ -0.05; & 0; & -0.05; \\ 0; & -0.05; & 0; \end{pmatrix}$$

(5)
$$\begin{pmatrix} 0; & -0.06; & 0; \\ -0.06; & 0; & -0.06; \\ 0; & 0.36; & 0; \\ -0.06; & 0; & -0.06; \\ 0; & -0.06; & 0; \end{pmatrix}$$

(6)
$$\begin{pmatrix} 0; & -0.05; & 0; \\ -0.02; & 0; & -0.02; \\ 0; & 0.18; & 0; \\ -0.02; & 0; & -0.02; \\ 0; & -0.05; & 0; \end{pmatrix}$$

(7)
$$\begin{pmatrix} 0; & -0.06; & 0; \\ -0.02; & 0; & -0.02; \\ 0; & 0.2; & 0; \\ -0.02; & 0; & -0.02; \\ 0; & -0.06; & 0; \end{pmatrix}$$

(8)
$$\begin{pmatrix} 0; & -0.1; & 0; \\ -0.02; & 0; & -0.02; \\ 0; & 0.28; & 0; \\ -0.02; & 0; & -0.02; \\ 0; & -0.1; & 0; \end{pmatrix}$$

(9)
$$\begin{pmatrix} 0; & -0.1; & 0; \\ -0.05; & 0; & -0.05; \\ 0; & 0.4; & 0; \\ -0.05; & 0; & -0.05; \\ 0; & -0.1; & 0; \end{pmatrix}$$

Fig. 7

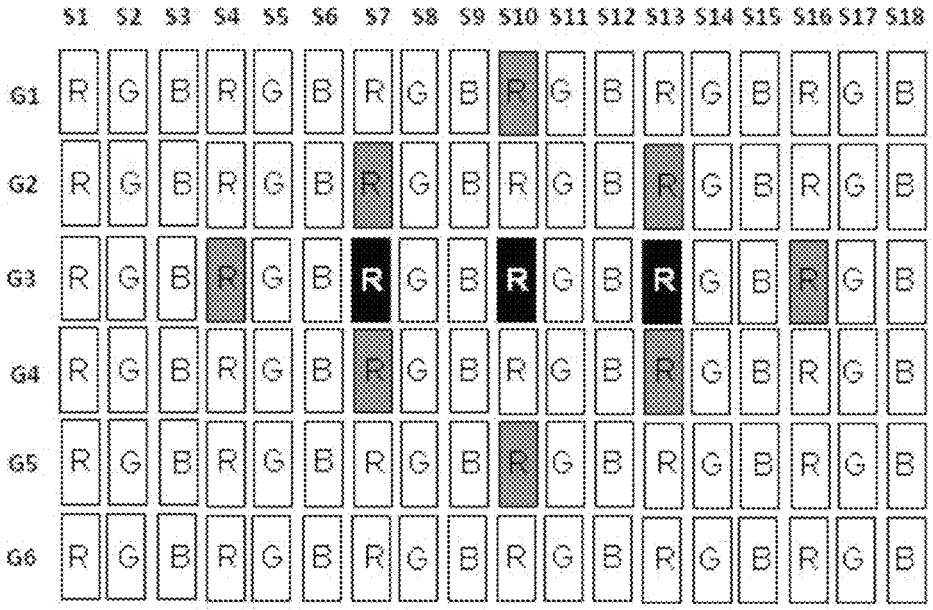

Fig. 8

| | | | | |
|---|---|---|---|---|
| 0; | 0; | -0.02; | 0; | 0; |
| 0; | -0.02; | 0; | -0.02; | 0; |
| -0.02; | 0; | 0.16; | 0; | -0.02; |
| 0; | -0.02; | 0; | -0.02; | 0; |
| 0; | 0; | -0.02; | 0; | 0; |

(2)

| | | | | |
|---|---|---|---|---|
| 0; | 0; | -0.03; | 0; | 0; |
| 0; | -0.03; | 0; | -0.03; | 0; |
| -0.03; | 0; | 0.24; | 0; | -0.03; |
| 0; | -0.03; | 0; | -0.03; | 0; |
| 0; | 0; | -0.03; | 0; | 0; |

(3)

| | | | | |
|---|---|---|---|---|
| 0; | 0; | -0.04; | 0; | 0; |
| 0; | -0.04; | 0; | -0.04; | 0; |
| -0.04; | 0; | 0.32; | 0; | -0.04; |
| 0; | -0.04; | 0; | -0.04; | 0; |
| 0; | 0; | -0.04; | 0; | 0; |

(4)

| | | | | |
|---|---|---|---|---|
| 0; | 0; | -0.05; | 0; | 0; |
| 0; | -0.05; | 0; | -0.05; | 0; |
| -0.05; | 0; | 0.4; | 0; | -0.05; |
| 0; | -0.05; | 0; | -0.05; | 0; |
| 0; | 0; | -0.05; | 0; | 0; |

(5)

| | | | | |
|---|---|---|---|---|
| 0; | 0; | -0.02; | 0; | 0; |
| 0; | -0.04; | 0; | -0.04; | 0; |
| -0.02; | 0; | 0.24; | 0; | -0.02; |
| 0; | -0.04; | 0; | -0.04; | 0; |
| 0; | 0; | -0.02; | 0; | 0; |

(6)

| | | | | |
|---|---|---|---|---|
| 0; | 0; | -0.04; | 0; | 0; |
| 0; | -0.06; | 0; | -0.06; | 0; |
| -0.04; | 0; | 0.4; | 0; | -0.04; |
| 0; | -0.06; | 0; | -0.06; | 0; |
| 0; | 0; | -0.04; | 0; | 0; |

(7)

| | | | | |
|---|---|---|---|---|
| 0; | 0; | -0.03; | 0; | 0; |
| 0; | -0.06; | 0; | -0.04; | 0; |
| -0.03; | 0; | 032; | 0; | -0.03; |
| 0; | -0.04; | 0; | -0.06; | 0; |
| 0; | 0; | -0.03; | 0; | 0; |

(8)

| | | | | |
|---|---|---|---|---|
| 0; | 0; | -0.01; | 0; | 0; |
| 0; | -0.07; | 0; | -0.07; | 0; |
| -0.01; | 0; | 0.32; | 0; | -0.01; |
| 0; | -0.07; | 0; | -0.07; | 0; |
| 0; | 0; | -0.01; | 0; | 0; |

(9)

| | | | | |
|---|---|---|---|---|
| 0; | 0; | -0.1; | 0; | 0; |
| 0; | -0.05; | 0; | -0.05; | 0; |
| -0.03; | 0; | 0.28; | 0; | -0.03; |
| 0; | -0.05; | 0; | -0.05; | 0; |
| 0; | 0; | -0.1; | 0; | 0; |

(1)

$$\begin{bmatrix} 0; & 0; & -0.02; & 0; & 0; \\ -0.02; & 0; & 0; & 0; & -0.02; \\ 0; & 0; & 0.12; & 0; & 0; \\ -0.02; & 0; & 0; & 0; & -0.02; \\ 0; & 0; & -0.02; & 0; & 0; \end{bmatrix}$$

(2)

$$\begin{bmatrix} 0; & 0; & -0.05; & 0; & 0; \\ -0.05; & 0; & 0; & 0; & -0.05; \\ 0; & 0; & 0.3; & 0; & 0; \\ -0.05; & 0; & 0; & 0; & -0.05; \\ 0; & 0; & -0.05; & 0; & 0; \end{bmatrix}$$

(3)

$$\begin{bmatrix} 0; & 0; & -0.06; & 0; & 0; \\ -0.06; & 0; & 0; & 0; & -0.06; \\ 0; & 0; & 0.36; & 0; & 0; \\ -0.06; & 0; & 0; & 0; & -0.06; \\ 0; & 0; & -0.06; & 0; & 0; \end{bmatrix}$$

(4)

$$\begin{bmatrix} 0; & 0; & -0.1; & 0; & 0; \\ -0.05; & 0; & 0; & 0; & -0.05; \\ 0; & 0; & 0.4; & 0; & 0; \\ -0.05; & 0; & 0; & 0; & -0.05; \\ 0; & 0; & -0.1; & 0; & 0; \end{bmatrix}$$

(5)

$$\begin{bmatrix} 0; & 0; & -0.02; & 0; & 0; \\ -0.08; & 0; & 0; & 0; & -0.08; \\ 0; & 0; & 0.36; & 0; & 0; \\ -0.08; & 0; & 0; & 0; & -0.08; \\ 0; & 0; & -0.02; & 0; & 0; \end{bmatrix}$$

(6)

$$\begin{bmatrix} 0; & 0; & -0.05; & 0; & 0; \\ -0.1; & 0; & 0; & 0; & -0.05; \\ 0; & 0; & 0.4; & 0; & 0; \\ -0.05; & 0; & 0; & 0; & -0.1; \\ 0; & 0; & -0.05; & 0; & 0; \end{bmatrix}$$

Fig. 11

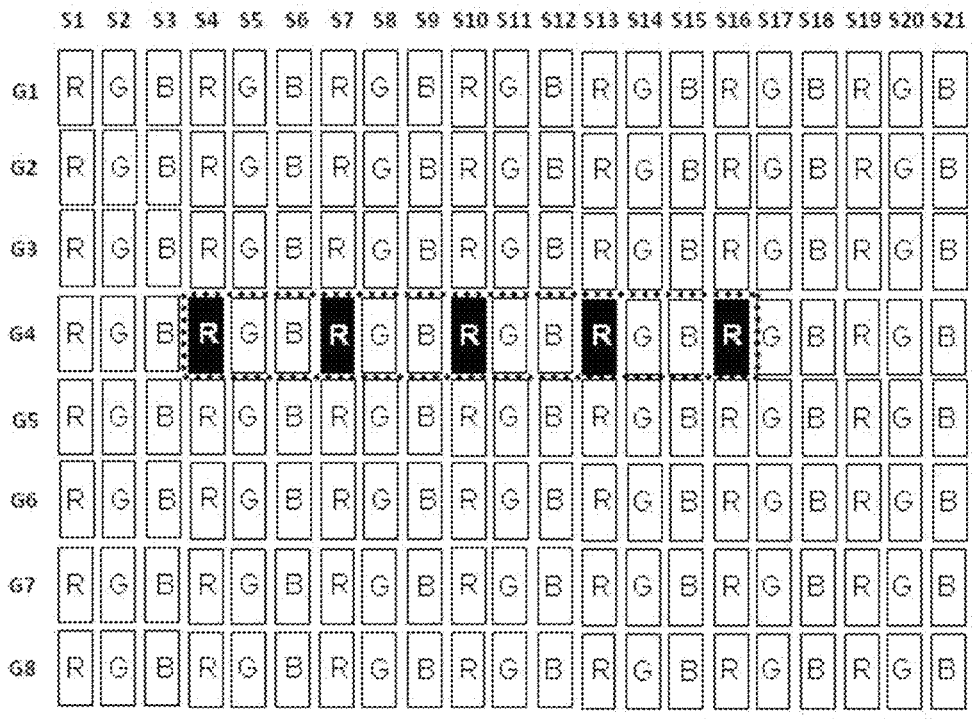

Fig. 12

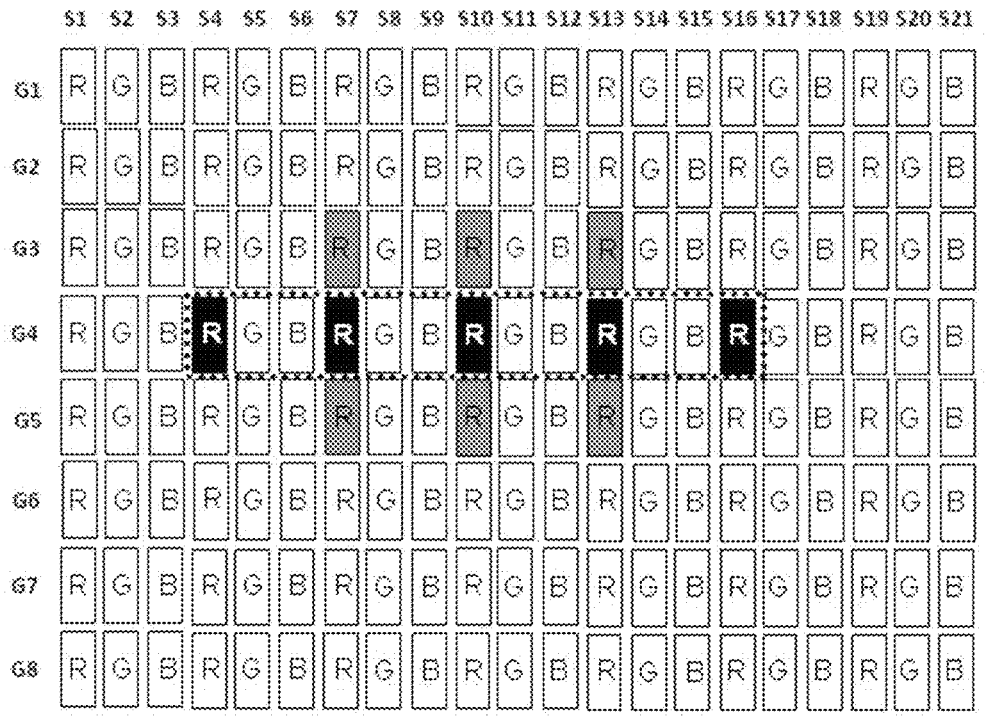

Fig. 13

(1)
$$\begin{pmatrix} 0; & -0.02; & -0.02; & -0.02; & 0; \\ 0; & 0; & 0.12; & 0; & 0; \\ 0; & -0.02; & -0.02; & -0.02; & 0; \end{pmatrix}$$

(2)
$$\begin{pmatrix} 0; & -0.02; & -0.05; & -0.02; & 0; \\ 0; & 0; & 0.18; & 0; & 0; \\ 0; & -0.02; & -0.05; & -0.02; & 0; \end{pmatrix}$$

(3)
$$\begin{pmatrix} 0; & -0.01; & -0.08; & -0.01; & 0; \\ 0; & 0; & 0.2; & 0; & 0; \\ 0; & -0.01; & -0.08; & -0.01; & 0; \end{pmatrix}$$

(4)
$$\begin{pmatrix} 0; & -0.05; & 0; & -0.05; & 0; \\ 0; & 0; & 0.2; & 0; & 0; \\ 0; & -0.05; & 0; & -0.05; & 0; \end{pmatrix}$$

(5)
$$\begin{pmatrix} 0; & -0.08; & 0; & -0.08; & 0; \\ 0; & 0; & 0.32; & 0; & 0; \\ 0; & -0.08; & 0; & -0.08; & 0; \end{pmatrix}$$

(6)
$$\begin{pmatrix} 0; & -0.1; & 0; & -0.1; & 0; \\ 0; & 0; & 0.4; & 0; & 0; \\ 0; & -0.1; & 0; & -0.1; & 0; \end{pmatrix}$$

(7)
$$\begin{pmatrix} 0; & 0; & -0.1; & 0; & 0; \\ 0; & 0; & 0.2; & 0; & 0; \\ 0; & 0; & -0.1; & 0; & 0; \end{pmatrix}$$

(8)
$$\begin{pmatrix} 0; & 0; & -0.15; & 0; & 0; \\ 0; & 0; & 0.3; & 0; & 0; \\ 0; & 0; & -0.15; & 0; & 0; \end{pmatrix}$$

(9)
$$\begin{pmatrix} 0; & 0; & -0.2; & 0; & 0; \\ 0; & 0; & 0.4; & 0; & 0; \\ 0; & 0; & -0.2; & 0; & 0; \end{pmatrix}$$

Fig. 14

$$\begin{pmatrix} -0.02; & -0.02; & -0.02; & -0.02; & -0.02; \\ 0; & 0; & 0.2; & 0; & 0; \\ -0.02; & -0.02; & -0.02; & -0.02; & -0.02; \end{pmatrix}$$

(2)

$$\begin{pmatrix} -0.01; & -0.02; & -0.05; & -0.02; & -0.01; \\ 0; & 0; & 0.18; & 0; & 0; \\ -0.01; & -0.02; & -0.05; & -0.02; & -0.01; \end{pmatrix}$$

(3)

$$\begin{pmatrix} -0.01; & -0.01; & -0.1; & -0.01; & -0.01; \\ 0; & 0; & 0.28; & 0; & 0; \\ -0.01; & -0.01; & -0.1; & -0.01; & -0.01; \end{pmatrix}$$

(4)

$$\begin{pmatrix} -0.03; & -0.01; & -0.1; & -0.03; & -0.01; \\ 0; & 0; & 0.36; & 0; & 0; \\ -0.01; & -0.03; & -0.1; & -0.01; & -0.03; \end{pmatrix}$$

(1)

$$\begin{pmatrix} 0; & -0.02; & -0.02; & -0.02; & -0.02; & -0.02; & 0; \\ -0.02; & 0; & 0; & 0.24; & 0; & 0; & -0.02; \\ 0; & -0.02; & -0.02; & -0.02; & -0.02; & -0.02; & 0; \end{pmatrix}$$

(2)

$$\begin{pmatrix} 0; & -0.01; & -0.02; & -0.05; & -0.02; & -0.01; & 0; \\ -0.01; & 0; & 0; & 0.2; & 0; & 0; & -0.01; \\ 0; & -0.01; & -0.02; & -0.05; & -0.02; & -0.01; & 0; \end{pmatrix}$$

(3)

$$\begin{pmatrix} 0; & -0.01; & -0.01; & -0.1; & -0.01; & -0.01; & 0; \\ -0.01; & 0; & 0; & 0.3; & 0; & 0; & -0.01; \\ 0; & -0.01; & -0.01; & -0.1; & -0.01; & -0.01; & 0; \end{pmatrix}$$

(4)

$$\begin{pmatrix} 0; & -0.03; & -0.01; & -0.1; & -0.03; & -0.01; & 0; \\ -0.01; & 0; & 0; & 0.36; & 0; & 0; & -0.01; \\ 0; & -0.01; & -0.03; & -0.1; & -0.01; & -0.03; & 0; \end{pmatrix}$$

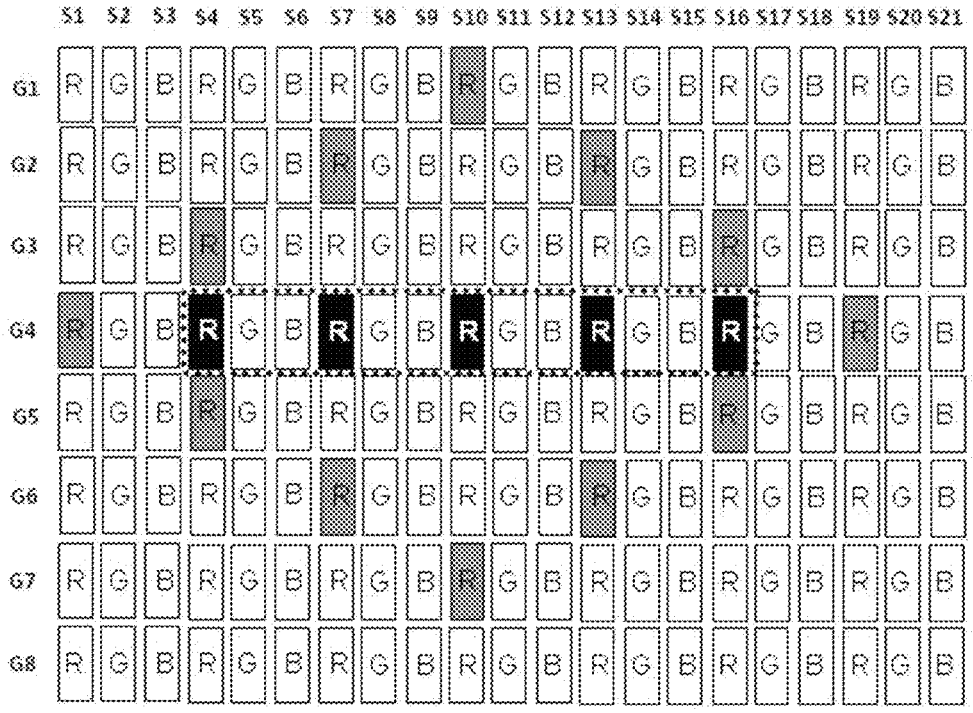

Fig. 19

(1)

$$\begin{pmatrix} 0; & 0; & 0; & -0.02; & 0; & 0; & 0; \\ 0; & 0; & -0.02; & 0; & -0.02; & 0; & 0; \\ 0; & -0.02; & 0; & 0; & 0; & -0.02; & 0; \\ -0.02; & 0; & 0; & 0.24; & 0; & 0; & -0.02; \\ 0; & -0.02; & 0; & 0; & 0; & -0.02; & 0; \\ 0; & 0; & -0.02; & 0; & -0.02; & 0; & 0; \\ 0; & 0; & 0; & -0.02; & 0; & 0; & 0; \end{pmatrix}$$

(2)

$$\begin{pmatrix} 0; & 0; & 0; & -0.05; & 0; & 0; & 0; \\ 0; & 0; & -0.02; & 0; & -0.02; & 0; & 0; \\ 0; & -0.01; & 0; & 0; & 0; & -0.01; & 0; \\ -0.01; & 0; & 0; & 0.2; & 0; & 0; & -0.01; \\ 0; & -0.01; & 0; & 0; & 0; & -0.01; & 0; \\ 0; & 0; & -0.02; & 0; & -0.02; & 0; & 0; \\ 0; & 0; & 0; & -0.05; & 0; & 0; & 0; \end{pmatrix}$$

(3)

$$\begin{pmatrix} 0; & 0; & 0; & -0.1; & 0; & 0; & 0; \\ 0; & 0; & -0.01; & 0; & -0.01; & 0; & 0; \\ 0; & -0.01; & 0; & 0; & 0; & -0.01; & 0; \\ -0.01; & 0; & 0; & 0.3; & 0; & 0; & -0.01; \\ 0; & -0.01; & 0; & 0; & 0; & -0.01; & 0; \\ 0; & 0; & -0.01; & 0; & -0.01; & 0; & 0; \\ 0; & 0; & 0; & -0.1; & 0; & 0; & 0; \end{pmatrix}$$

(4)

$$\begin{pmatrix} 0; & 0; & 0; & -0.1; & 0; & 0; & 0; \\ 0; & 0; & -0.01; & 0; & -0.03; & 0; & 0; \\ 0; & -0.03; & 0; & 0; & 0; & -0.01; & 0; \\ -0.01; & 0; & 0; & 0.36; & 0; & 0; & -0.01; \\ 0; & -0.01; & 0; & 0; & 0; & -0.03; & 0; \\ 0; & 0; & -0.03; & 0; & -0.01; & 0; & 0; \\ 0; & 0; & 0; & -0.1; & 0; & 0; & 0; \end{pmatrix}$$

Fig. 20

PIXEL ARRAY, DRIVING METHOD THEREOF, DISPLAY PANEL AND DISPLAY DEVICE

CROSS-REFERENCE TO RELATED APPLICATIONS

This patent application is a continuation of U.S. patent application Ser. No. 14/415,947 filed on Jan. 20, 2015, entitled PIXEL ARRAY, DRIVING METHOD THEREOF, DISPLAY PANEL AND DISPLAY DEVICE, which is a 371 of PCT/CN2014/081.205 filed on Jun. 30, 2014, which claims priority to Chinese Patent Application No. CN 201310743230.2 filed on Dec. 30, 2013, the content of each of which is hereby incorporated by reference in its entirety.

FIELD OF THE INVENTION

The present invention relates to the field of display technology, and particularly to a pixel array, a driving method of the pixel array, a display panel including the pixel array, and a display device including the display panel.

BACKGROUND OF THE INVENTION

In a current display panel, as a common pixel design, three sub-pixels (including a red sub-pixel, a green sub-pixel, and a blue sub-pixel) or four sub-pixels (including a red sub-pixel, a green sub-pixel, a blue sub-pixel, and a white sub-pixel) constitute a pixel for display.

If pixel per inch (PPI) of a display panel is small, a user watching a display screen would obviously feel a granular sensation (i.e., edges of displayed images are not smooth, but serrated). With users' increasing demand on viewing experience of the display screen, the PPI of the display panel needs to be increased. An increase in the PPI of the display panel may add difficulty to a manufacturing process of the display panel.

It has become an urgent technical problem how to lower the granular sensation of the display panel to achieve a display effect of a display panel with higher resolution in the same size, without adding difficulty to the manufacturing process.

SUMMARY OF THE INVENTION

An object of the present invention is to provide a pixel array, a driving method thereof, a display panel including the pixel array, and a display device including the display panel, and when the driving method is used to drive the pixel array, a granular sensation of the display panel can be lowered, and a display effect of a display panel with higher resolution in the same size can be achieved.

In order to achieve the above object, as an aspect of the present invention, there is provided a pixel array, comprising a plurality of pixel units, each of which comprises three sub-pixels in different colors, wherein, in each pixel unit, any two adjacent sub-pixels are combined into a pixel block.

As another aspect of the present invention, there is provided a driving method of a pixel array, wherein, the pixel array is the above pixel array provided by the present invention, and the driving method comprises steps of:

S1, calculating theoretical brightness values of an image to be displayed at respective sub-pixels;

S2, calculating actual brightness values of the respective sub-pixels, wherein, the actual brightness value of each sub-pixel at least includes a sum of a part of the theoretical brightness value of the sub-pixel and a part of the theoretical brightness values of one or more sub-pixels in the same color as the sub-pixel in the same row; and S3, inputting signals to the respective sub-pixels, so that the respective sub-pixels reach the actual brightness values calculated in step S2.

Preferably, the pixel array comprises X rows and Y columns of sub-pixels, and in step S2, the actual brightness value A(m, n) of the sub-pixel in row m and column n is calculated according to the following formula:

$$A(m,n)=a*T(m,n-3)+b*T(m,n)+a*T(m,n+3),$$

wherein, T(m, n) is the theoretical brightness value of the sub-pixel in row m and column n, n−3) is the theoretical brightness value of the sub-pixel in row m and column n−3, T(m, n+3) is the theoretical brightness value of the sub-pixel in row m and column n+3, $3<n\leq Y-3$, $a>0$, $b>0$, and $2a+b=1$.

Preferably, the pixel array comprises X rows and Y columns of sub-pixels, and in step S2, the actual brightness value A(m, n) of the sub-pixel in row m and column n is calculated according to the following formula:

$$A(m,n)=g*T(m,n-6)+h*T(m,n-3)+i*T(m,n)+h*T(m,n+3)+g*T(m,n+6);$$

wherein, T(m, n) is the theoretical brightness value of the sub-pixel in row m and column n, T(m, n−3) is the theoretical brightness value of the sub-pixel in rode m and column n−3, T(m, n+3) is the theoretical brightness value of the sub-pixel in row m and column n+3, T(m, n−6) is the theoretical brightness value of the sub-pixel in row m and column n−6, T(m, n+6) is the theoretical brightness value of the sub-pixel in row m and column n+6, $g>0$, $h>0$, $i>0$, $2g+2h+i=1$, and $6<n\leq Y=6$.

Preferably, in step S2, the actual brightness value of each sub-pixel includes the sum of a part of the theoretical brightness value of the sub-pixel and a part of the theoretical brightness values of one or more sub-pixels in the same color as the sub-pixel in the same row minus a part of the theoretical brightness values of one or more sub-pixels in the same color as the sub-pixel in different rows.

Preferably, the pixel array comprises X rows and Y columns of sub-pixels, and in step S2, the actual brightness value A(m, n) of the sub-pixel in row m and column n is calculated according to the following formula:

$$A(m,n)=a*T(m,n-3)+\left(b+\sum_{i=1}^{4}e_i\right)*T(m,n)+a*T(m,n+3)-[e_1*T(m-1,n-3)+e_2*T(m+1,n-3)+e_3*T(m-1,n+3)+e_4*T(m+1,n+3)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, $1<m<X$, $3<n\leq Y-3$, $a>0$, $b>0$, $e_i>0$, $2a+b=1$, and $$\sum_{i=1}^{4} e_i \leqslant 0.4.$$

Preferably, the pixel array comprises X rows and Y columns of sub-pixels, and in step S2, the actual brightness value A(m, n) of the sub-pixel in row m and column n is calculated according to the following formula:

$$A(m, n) = a * T(m, n-3) + \left(b + \sum_{i=1}^{6} f_i\right) * T(m, n) + a * T(m, n+3) - [f_1 * T(m-1, n-3) + f_2 * T(m-1, n+3) + f_3 * T(m+1, n-3) + f_4 * T(m+1, n+3) + f_5 * T(m-1, n) + f_6 * T(m+1, n)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(n+3) is the theoretical brightness value of the sub-pixel in row m−1 and column n+3, T(m+1, n−3) is the theoretical brightness value of the sub-pixel row m+1 and column n−3, T(m+1, n+3) is the theoretical brightness value of the sub-pixel in row m+1 and column n+3, T(m+1, n) is the theoretical brightness value of the sub-pixel in row m+1 and column n, T(m−1, n) is the theoretical brightness value of the sub-pixel in row m−1 and column n, 1<m<X, 3<n≤Y−3, a>0, b>0, $f_i$>0, 2a+b=1, and $$\sum_{i=1}^{4} f_i \leqslant 0.4.$$

Preferably, the pixel array comprises X rows and Y columns of sub-pixels, and in step S2, the actual brightness value A(m, n) of the sub-pixel in row m and column n is calculated according to the following formula:

$$A(m, n) = a * T(m, n-3) + \left(b + \sum_{i=1}^{6} e_i\right) * T(m, n) + a * T(m, n+3) - [g_1 * T(m-1, n-3) + g_2 * T(m+1, n+3) + g_3 * T(m-1, n+3) + g_4 * T(m+1, n+3) + g_5 * T(m-2, n) + g_6 * T(m+2, n)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, T(m+2, n) is the theoretical brightness value of the sub-pixel in row m+2 and column n, T(m−2, n) is the theoretical brightness value of the sub-pixel in row m−2 and column n, 2<m≤X−2, 3<n≤Y−3, a>0, b>0, $g_i$>0, 2a+b=1, and $$\sum_{i=1}^{6} g_i \leqslant 0.4.$$

Preferably, the pixel array comprises X rows and Y columns of sub-pixels, and in step S2, the actual brightness value A(m, n) of the sub-pixel in row m and column n is calculated according to the following formula:

$$A(m, n) = a * T(m, n-3) + \left(b + \sum_{i=1}^{8} H_i\right) * T(m, n) + a * T(m, n+3) - [H_1 * T(m-1, n-3) + H_2 * T(m+1, n-3) + H_3 * T(m-1, n+3) + H_4 * T(m+1, n+3) + H_5 * T(m-2, n) + H_6 * T(m+2, n) + H_7 * T(m, n-6) + H_8 * T(m, n+6)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, T(m+2, n) is the theoretical brightness value of the sub-pixel in row m+2 and column n, T(m−2, n) is the theoretical brightness value of the sub-pixel in row m−2 and column n, T(m, n±6) is the theoretical brightness value of the sub-pixel in row m and column n±6, T(m, n−6) is the theoretical brightness value of the sub-pixel in row m and column n−6, 2<m≤X−2, 6<n≤Y−6, a>0, b>0, $H_i$>0, 2a+b=1, and $$\sum_{i=1}^{8} H_i \leqslant 0.4.$$

Preferably, the pixel array comprises X rows and Y columns of sub-pixels, and in step S2, the actual brightness value A(m, n) of the sub-pixel in row m and column n is calculated according to the following formula:

$$A(m, n) = a * T(m, n-3) + \left(b + \sum_{i=1}^{6} L_i\right) * T(m, n) + a * T(m, n+3) - [L_1 * T(m-1, n-6) + L_2 * T(m+1, n-6) + L_3 * T(m-1, n+6) + L_4 * T(m+1, n+6) + L_5 * T(m-2, n) + L_6 * T(m+2, n)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−6) is the theoretical brightness value of the sub-pixel in row m−1 and column n−6, T(m−1, n+6) is the theoretical brightness value of the sub-pixel in row m−1 and column n+6, T(m+1, n−6) is the theoretical brightness value of the sub-pixel in row m+1 and column n−6, T(m+1, n+6) is the theoretical brightness value of the sub-pixel in row m+1 and column n+6, T(m−2, n) is the theoretical brightness value of the sub-pixel in row m−2 and column n, T(m+2, n) is the theoretical brightness value of the sub-pixel in row m+2 and column n, 2<m≤X−2, 6<n≤Y−6, a>0, b>0, $L_i$>0, 2a+b=1, and $$\sum_{i=1}^{6} L_i \leqslant 0.4.$$

Preferably, the pixel array comprises X rows and Y columns of sub-pixels, and in step S2, the actual brightness value A(m, n) of the sub-pixel in row m and column n is calculated according to the following formula:

$$A(m,n) = g*T(m,n-6) + h*T(m,n-3) + \left(i + \sum_{i=1}^{6} M_i\right)*T(m,n) + h*T(m,n+3) + g*T(m,n+6) - [M_1*T(m-1,n-3) + M_2*T(m-1,n+3) + M_3*T(m+1,n-3) + M_4*T(m+1,n+3) + M_5*T(m-1,n) + M_6*T(m+1,n)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m, n−6) is the theoretical brightness value of the sub-pixel in row m and column n−6, T(m, n+6) is the theoretical brightness value of the sub-pixel in row m and column n+6, T(m+1, n) is the theoretical brightness value of the sub-pixel in row m+1 and column n, T(m−1, n) is the theoretical brightness value of the sub-pixel in row m−1 and column n, T(m−1, n+3) is the theoretical brightness value of the sub-pixel in row m−1 and column n+3, T(m−1, n−3) is the theoretical brightness value of the sub-pixel in row m−1 and column n−3, T(m+1, n+3) is the theoretical brightness value of the sub-pixel in row m+1 and column n+3, T(m+1, n−3) is the theoretical brightness value of the sub-pixel in row m+1 and column n−3, g>0, h>0, i>0, $M_i$≥0, 2g+2h+i=1, $$0 < \sum_{i=1}^{6} M_i \leqslant 0.4,$$

6<n≤Y−6 and 1<m<X.

Preferably, the pixel array comprises X rows and Y columns of sub-pixels, and in step S2, the actual brightness value A(m, n) of the sub-pixel in row m and column n is calculated according to the following formula:

$$A(m,n) = g*T(m,n-6) + h*T(m,n-3) + \left(i + \sum_{i=1}^{10} N_i\right)*T(m,n) + h*T(m,n+3) + g*T(m,n+6) - [N_1*T(m-1,n-6) + N_2*T(m-1,n-3) + N_3*T(m-1,n) + N_4*T(m-1,n+3) + N_5*T(m-1,n+6) + N_6*T(m+1,n-6) + N_7*T(m+1,n-3) + N_8*T(m+1,n) + N_9*T(m+1,n+3) + N_{10}*T(m+1,n+6)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m n−6) is the theoretical brightness value of the sub-pixel in row in and column n−6, T(m, n+6) is the theoretical brightness value of the sub-pixel in row m and column n+6, T(m−1, n−6) is the theoretical brightness value of the sub-pixel in row m−1 and column n−6, T(m−1, n−3) is the theoretical brightness value of the sub-pixel in row m−1 and column n−3, T(m−1, n) is the theoretical brightness value of the sub-pixel in row m−1 and column n, T(m−1, n+3) is the theoretical brightness value of the sub-pixel in row m−1 and column n+3, T(m−1, n+6) is the theoretical brightness value of the sub-pixel in row m−1 and column n+6, T(m+1, n−6) is the theoretical brightness value of the sub-pixel in row m+1 and column n−6, T(m+1 n−3) is the theoretical brightness value of the sub-pixel in row m+1 and column n−3, T(m+1, n) is the theoretical brightness value of the sub-pixel in row m+1 and column n, T(m+1, n+3) is the theoretical brightness value of the sub-pixel in row m+1 and column n+3, T(m+1, n+6) is the theoretical brightness value of the sub-pixel in row m+1 and column n+6, g>0, h>0, i>0, $N_i$≥0, 2g+2h+i=1, $$0 < \sum_{i=1}^{10} N_i \leqslant 0.4,$$

6<n≤Y−6 and 1<m<X.

Preferably, the pixel array comprises X rows and Y columns of sub-pixels, and in step S2, the actual brightness value A(m, n) of the sub-pixel in row m and column n is calculated according to the following formula:

$$A(m,n) = g*T(m,n-6) + h*T(m,n-3) + \left(i + \sum_{i=1}^{12} o_i\right)*T(m,n) + h*T(m,n+3) + g*T(m,n+6) - [o_1*T(m-1,n-6) + o_2*T(m-1,n-3) + o_3*T(m-1,n) + o_4*T(m-1,n+3) + o_5*T(m-1,n+6) + o_6*T(m+1,n-6) + o_7*T(m+1,n-3) + o_8*T(m+1,n) + o_9*T(m+1,n+3) + o_{10}*T(m+1,n+6) + o_{11}*T(m,n-9) + o_{12}*T(m,n+9)];$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m, n−6) is the theoretical brightness value of the sub-pixel in row m and column n−6, T(m, n+6) is the theoretical brightness value of the sub-pixel in row m and column n+6, T(m, n+9) is the theoretical brightness value of the sub-pixel in row m and column n+9, T(m, n−9) is the theoretical brightness value of the sub-pixel in row m and column n−9, T(m−1, n−6) is the theoretical brightness value of the sub-pixel in row m−1 and column n−6, T(m−1, n−3) is the theoretical brightness value of the sub-pixel in row m−1 and column n−3, T(m−1, n) is the theoretical brightness value of the sub-pixel in row m−1 and column n, T(m−1, n+3) is the theoretical brightness value of the sub-pixel in row m−1 and column n+3, T(m−1, n+6) is the theoretical brightness value of the sub-pixel in row m−1 and column n+6, T(m+1, n−6) is the theoretical brightness value of the sub-pixel in row m+1 and column n−6, T(m+1, n−3) is the theoretical brightness value of the sub-pixel in row m+1 and column n−3, T(m+1, n) is the theoretical brightness value of the sub-pixel in row m+1 and column n, T(m+1, n+3) is the theoretical brightness value of the sub-pixel in row m+1 and column n+3, T(m+1, n+6) is the theoretical brightness value of the sub-pixel in row m+1 and column n+6, g>0, h>0, i>0, $o_i \leq 0$, 2g+2h+i=1, $$0 < \sum_{i=1}^{12} o_i \leq 0.4,$$

9<n≤Y−9 and 1<m<X.

Preferably, the pixel array comprises X rows and Y columns of sub-pixels, and in step S2, the actual brightness value A(m, n) of the sub-pixel in row m and column n is calculated according to the following formula:

$$\begin{aligned} A(m, n) = {} & g * T(m, n-6) + h * T(m, n-3) + \\ & \left(i + \sum_{i=1}^{12} p_i\right) * T(m, n) + h * T(m, n+3) + g * T(m, n+6) - \\ & [p_1 * T(m, n-9) + p_2 * T(m+1, n-6) + p_3 * T(m+2, n-3) + \\ & p_4 * T(m+3, n) + p_5 * T(m+2, n+3) + p_6 * T(m+1, n+6) + \\ & p_7 * T(m, n+9) + p_8 * T(m-1, n+6) + p_9 * T(m-2, n+3) + \\ & p_{10} * T(m-3, n) + p_{11} * T(m-2, n-3) + p_{12} * T(m-1, n-6)]; \end{aligned}$$

wherein, T(m, n−6) is the theoretical brightness value of the sub-pixel in row m and column n−6, T(m, n−3) is the theoretical brightness value of the sub-pixel in row in and column n−3, T(m, n) is the theoretical brightness value of the sub-pixel in row m and column n, T(m, n+3) is the theoretical brightness value of the sub-pixel in row in and column n+3, T(m, n+6) is the theoretical brightness value of the sub-pixel in row m and column n+6, T(m, n−9) is the theoretical brightness value of the sub-pixel in row m and column n−9, T(m+1, n−6) is the theoretical brightness value of the sub-pixel in row m+1 and column n−6, T(+2, n−3) is the theoretical brightness value of the sub-pixel in row m+2 and column n−3, T(m+3, n) is the theoretical brightness value of the sub-pixel in row m+3 and column n, T(m+2, n+3) is the theoretical brightness value of the sub-pixel in row m+2 and column n+3, T(m+1, n+6) is the theoretical brightness value of the sub-pixel in row m+1 and column n+6, T(m, n+9) is the theoretical brightness value of the sub-pixel in row m and column n+9, T(m−1, n+6) is the theoretical brightness value of the sub-pixel in row m+1 and column n+6, T(m−2, n+3) is the theoretical brightness value of the sub-pixel in row m−2 and column n+3, T(m−3, n) is the theoretical brightness value of the sub-pixel in row m−3 and column n, T(m−2, n−3) is the theoretical brightness value of the sub-pixel in row m−2 and column n−3, T(m−1, n−6) is the theoretical brightness value of the sub-pixel in row m−1 and column n−6, g>0, h>0, i>0, $p_i \geq 0$, 2g+2h+i=1, $$0 < \sum_{i=1}^{12} p_i \leq 0.4,$$

9<n≤Y−9 and 3<m<X−3.

As still another aspect of the present invention, there is provided a display panel comprising a pixel array, wherein, the pixel array is the above pixel array provided by the present invention.

As still yet another aspect of the present invention, there is provided a display device comprising a display panel, wherein, the display panel is the above display panel provided by the present invention.

In the pixel array of the present invention, two adjacent sub-pixels in the same row can be combined into a pixel block. It can be seen that, compared to the prior art, the sub-pixel of the present invention has an increased width, which reduces the difficulty of the manufacturing process of the pixel array and improves product yield. Further, when driving the above pixel array with the driving method, a granular sensation of the display panel including the pixel array can be reduced, and a display effect of a display panel with higher resolution in the same size can be achieved.

BRIEF DESCRIPTION OF THE DRAWINGS

The accompanying drawings, as a part of the specification, are used for providing a further understanding of the present invention, and explaining the present invention together with the following specific implementations, rather than limiting the present invention. In the drawings:

FIG. 3 is an algorithm matrix of calculating actual brightness of the sub-pixel in row G3 and column S10 by using the driving method of a pixel array in the second implementation provided by the present invention;

FIG. 4 is a schematic diagram of a distribution of other sub-pixels that are in the same color and need to be used when actual brightness of the sub-pixel in row G3 and column S10 is calculated by using a driving method of a pixel array in the third implementation provided by the present invention;

FIG. 5 is an algorithm matrix in calculating actual brightness of the sub-pixel in row G3 and column S10 by using the driving method of a pixel array in the third implementation provided by the present invention;

FIG. 6 is a schematic diagram of a distribution of other sub-pixels that are in the same color and need to be used when actual brightness of the sub-pixel in row G3 and column S10 is calculated by using a driving method of a pixel array in the fourth implementation provided by the present invention;

FIG. 7 is an algorithm matrix in calculating actual brightness of the sub-pixel in row G3 and column S10 by using the driving method of a pixel array in the fourth implementation provided by the present invention;

FIG. 8 is a schematic diagram of a distribution of other sub-pixels that are in the same color and need to be used when actual brightness of the sub-pixel in row G3 and column S10 is calculated by using a driving method of a pixel array in the fifth implementation provided by the present invention;

FIG. 11 is an algorithm matrix in calculating actual brightness of the sub-pixel in row G3 and column S10 by using the driving method of a pixel array in the sixth implementation provided by the present invention;

FIG. 12 is a schematic diagram of a distribution of other sub-pixels that are in the same color and need to be used when actual brightness of the sub-pixel in row G4 and column. S10 is calculated by using a driving method of a pixel array in the seventh implementation provided by the present invention;

FIG. 13 is a schematic diagram of a distribution of other sub-pixels that are in the same color and need to be used when actual brightness of the sub-pixel in row G4 and column S10 is calculated by using a driving method of a pixel array in the eighth implementation provided by the present invention;

FIG. 14 is an algorithm matrix in calculating actual brightness of the sub-pixel in row G4 and column S10 by using the driving method of a pixel array in the eighth implementation provided by the present invention;

FIG. 19 is a schematic diagram of a distribution of other sub-pixels that are in the same color and need to be used when actual brightness of the sub-pixel in row G4 and column S10 is calculated by using a driving method of a pixel array in the eleventh implementation provided by the present invention; and FIG. 20 is an algorithm matrix in calculating actual brightness of the sub-pixel in row G4 and column S10 by using the driving method of a pixel array in the eleventh implementation provided by the present invention.

DETAILED DESCRIPTION OF THE EMBODIMENTS

Specific implementations of the present invention will be described in detail below in conjunction with the accompanying drawings. It should be understood that, the specific implementations described herein are merely used for illustrating and explaining the present invention, rather than limiting the present invention.

Figure 1:
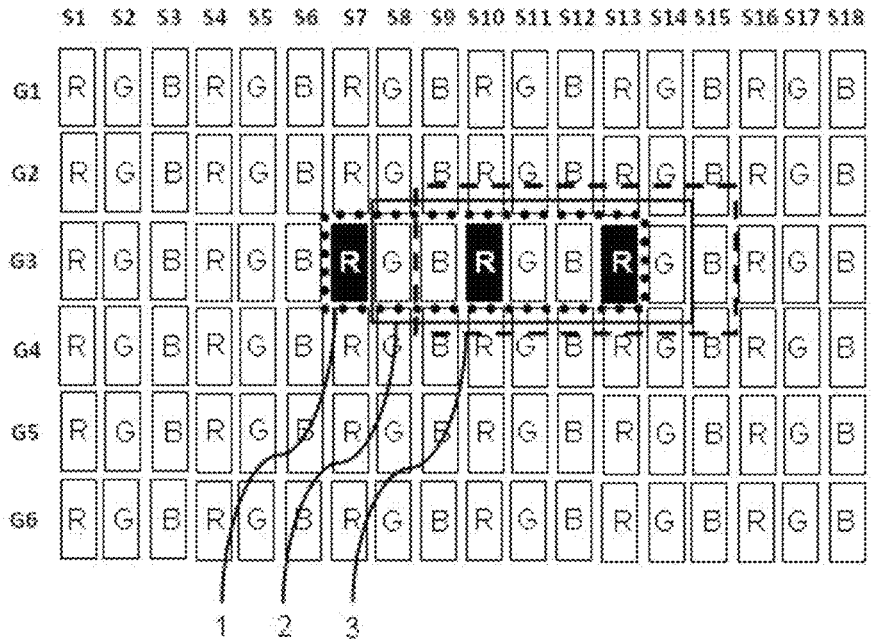
FIG. 1 is a schematic diagram of a distribution of other sub-pixels that are in the same color and need to be used when actual brightness of the sub-pixel in row G3 and column S10 is calculated by using a driving method of a pixel array in the first implementation provided by the present invention.

As shown in FIG. 1, as an aspect of the present invention, there is provided a pixel array comprising a plurality of pixel units, each of which comprises three sub-pixels in different colors (i.e., a red sub-pixel R, a green sub-pixel G and a blue sub-pixel B), wherein in each pixel unit, any two adjacent sub-pixels are combined into a pixel block.

In the prior art, generally, three sub-pixels sequentially arranged in the same row are combined into a pixel block as a physical pixel unit, and the pixel block may be square or squarish in shape, namely, a width of each sub-pixel is about one third of a length thereof if each sub-pixel has the same size. In the present invention, two adjacent sub-pixels in the same row are combined into a pixel block of the same size, that is, two sub-pixels in the present invention may occupy an area with the same size as three sub-pixels in the prior art, and if the two sub-pixels have the same size, a width of each of the sub-pixels is about one two of a length of the sub-pixel. It can be seen that, compared to the prior art, the width of the sub-pixel in the present invention increases, which reduces the difficulty of the manufacturing process of the pixel array and improves product yield.

Two adjacent sub-pixels in the same row can be deemed as constituting a square or squarish pixel block. It should be understood that, the term "square" used here means that the length and the width of the pixel block are approximately equal, or, a ratio of the width of the pixel block to the length thereof is in the range of 0.8 to 1.2. Needless to say, the pixel block may also have other shape or aspect ratio.

With respect to each sub-pixel, the width thereof may be a half of the length thereof. Needless to say, the structure of each sub-pixel is not strictly limited thereto, for example, for each sub-pixel, the width thereof may be two fifths to three fifths of the length thereof, so that it can be ensured that two adjacent sub-pixels may be combined into the above square pixel block.

Namely, when the pixel array is used in an array substrate, gate lines and data lines intersect with each other to divide the array substrate into the plurality of pixel units. A length of each sub-pixel in a gate line direction is a half of that in a data line direction.

In a display panel with a resolution of X*Y, the pixel array may include X rows and Y columns of sub-pixels, for example, in a display panel with a resolution of 1024*768, the pixel array includes 1024 rows and 768 columns of sub-pixels.

As another aspect of the present invention, there is provided a driving method for driving the above pixel array provided by the present invention, and the driving method comprises steps of:

S1, calculating theoretical brightness values of an image to be displayed at respective sub-pixels;

S2, calculating actual brightness values of the respective sub-pixels, wherein, the actual brightness value of each sub-pixel at least includes a part of the theoretical brightness value of the sub-pixel and a part of the theoretical brightness value(s) of one or more sub-pixels in the same color as the sub-pixel in the same row; and S3, inputting signals to the respective sub-pixels, so that the respective sub-pixels reach the actual brightness values calculated in step S2.

In step S2 of the driving method provided by the present invention, the actual brightness output to one sub-pixel at least includes a sum of a part of the theoretical brightness value of the sub-pixel and a part of the theoretical brightness value of sub-pixels in the same color as the sub-pixel and adjacent to the sub-pixel in the same row, which is equivalent to that, in display, one sub-pixel shares brightness signals of other sub-pixels in the same color as said one sub-pixel so that a transition between adjacent sub-pixels becomes smoother. When driving the pixel array with the above driving method, a granular sensation of the display panel including the pixel array provided by the present invention can be reduced, and a display effect of a display panel with higher resolution in the same size can be achieved.

For example, as shown in FIG. 1, when calculating the actual brightness value of a red sub-pixel R in row G3 and column S10, the theoretical brightness value of the red sub-pixel R in row G3 and column S10, the theoretical brightness value of the red sub-pixel R in row G3 and column S7 and the theoretical brightness value of the red sub-pixel R in row G3 and column S13 may be used for calculation.

As a preferable implementation of the present invention, when the pixel array includes X rows and Y columns of sub-pixels, in step S2, the actual brightness A(m, n) of the sub-pixel in row m and column n is calculated according to the following formula (1):

$$A(m,n)=a*T(m,n-3)+b*T(m,n)+a*T(m,n+3) \quad (1)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, $3<n\leq Y-3$, $a>0$, $b>0$, and $2a+b=1$.

For example, the actual brightness value of the red sub-pixel R in row G3 and column S10 (i.e., the sub-pixel in row 3 and column 10) in FIG. 1 is A(3, 10), and the theoretical brightness value T(3, 10) of the sub-pixel in row 3 and column 10, the theoretical brightness value T(3, 7) of the sub-pixel in row 3 and column 7 and the theoretical brightness value T(3, 13) of the sub-pixel in row 3 and column 13 are needed.

Values of a and b are not limited as long as conditions $a>0$, $b>0$, and $2a+b=1$ are satisfied. For example, b may have a value of 0.7, and then a may have a value of 0.15, and in this case, A(3, 10)=0.15*T(3, 7)+0.7*T(3, 10)+0.15*T(3, 13).

It can be easily understood that, FIG. 1 illustrates only a part of the pixel army. The pixel array may comprise middle sub-pixels and boundary sub-pixels. In the first implementation as shown in FIG. 1, the middle sub-pixels may refer to sub-pixels from the fourth column (including the fourth column) to the fourth-last column (including the fourth-last column), and the boundary sub-pixels may refer to the first three columns of sub-pixels and the last three columns of sub-pixels. The actual brightness values of the middle sub-pixels may be directly calculated by using the above formula (1). In general, Y is far larger than 3, and therefore, in the whole pixel array, outputs of the first three columns of sub-pixels and the last three columns of sub-pixels (boundary sub-pixels) have little effect on the display of the entire pixel array, and in display, signals may be input to the first three columns of sub-pixels and the last three columns of sub-pixels based on the theoretical brightness values.

In order to reduce the granular sensation of the display panel including the pixel array and achieve the display effect of a display panel with a higher resolution in the same size, the actual brightness values of the first three columns of sub-pixels may be calculated according to the following formula (2) and the actual brightness values of the last three columns of sub-pixels may be calculated according to the following formula (3) while calculating the actual brightness values of the middle sub-pixels according to the above formula (1):

$$A(m,n)=c*T(m,n)+d*T(m,n+3) \quad (2)$$

wherein, $n\leq 3, c>0, d>0$, and $c+d=1$;

$$A(m,n)=e*T(m,n-3)+f*T(m,n) \quad (3)$$

wherein, $n>Y-3, e>0, f>0$, and $e+f=1$.

In the implementation of the present invention shown in FIG. 1, when calculating the actual brightness of one sub-pixel, the theoretical brightness values of two sub-pixels in the same color and adjacent thereto in the same row are used. In FIG. 1, the dotted box denoted by reference numeral 1 indicates that the red sub-pixel in row G3 and column S7 and the red sub-pixel in row G3 and column S13 are needed when calculating the red sub-pixel in row G3 and column S10; the solid box denoted by reference numeral 2 indicates that the green sub-pixel in row G3 and column S8 and the green sub-pixel in row G3 and column S14 are needed when calculating the green sub-pixel in row G3 and column S11; the dashed box denoted by reference numeral 3 indicates that the blue sub-pixel in row G3 and column S9 and the blue sub-pixel in row G3 and column S15 are needed when calculating the blue sub-pixel in row G3 and column S12.

In order to reduce the granular sensation of the display panel including the pixel array provided by the present invention and achieve the display effect of a display panel with a higher resolution in the same size, preferably, the actual brightness value of each sub-pixel includes the sum of a part of the theoretical brightness value of the sub-pixel and a part of the theoretical brightness value(s) of one or more sub-pixels in the same color as the sub-pixel in the same row minus a part of the theoretical brightness value(s) of one or more sub-pixels in the same color as the sub-pixel in different rows. Here, the subtracted "the theoretical brightness value(s) of one or more sub-pixels in the same color as the sub-pixel in different rows" is equivalent to attenuation to the brightness of one or more sub-pixels in different rows, which can reduce the granular sensation of the display panel including the pixel array.

Figure 2:
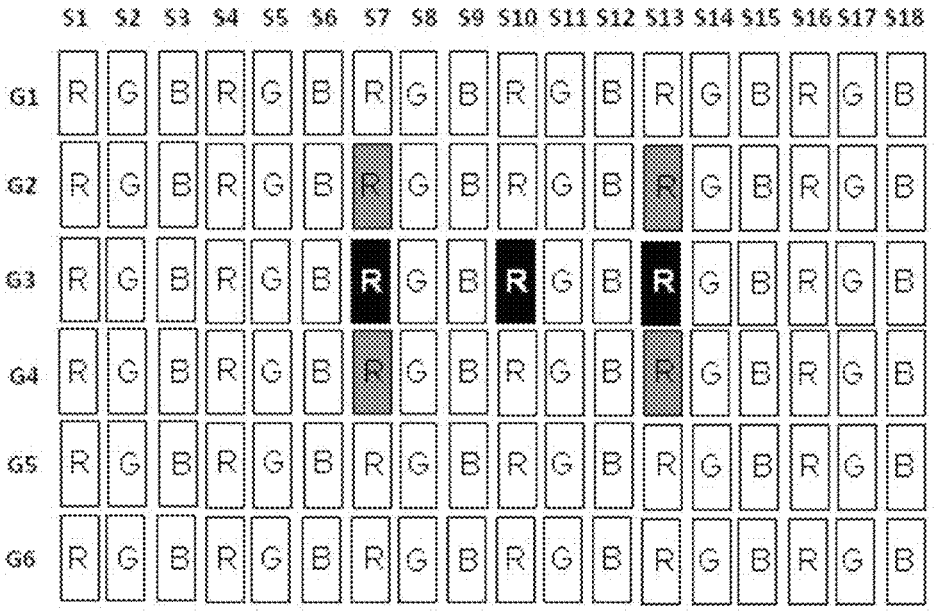
FIG. 2 is a schematic diagram of a distribution of other sub-pixels that are in the same color and need to be used when actual brightness of the sub-pixel in row G3 and column S10 is calculated by using a driving method of a pixel array in the second implementation provided by the present invention.

As shown in FIG. 2, in the second implementation of the present invention, when calculating the actual brightness value of the sub-pixel in row G3 and column S10, in addition to the theoretical brightness value of the sub-pixel in row G3 and column S10, the theoretical brightness value of the sub-pixel in row G3 and column S7 and the theoretical brightness value of the sub-pixel in row G3 and column S13, the theoretical brightness value of the sub-pixel in row G2 and column S7, the theoretical brightness value of the sub-pixel in row G2 and column S13, the theoretical brightness value of the sub-pixel in row G4 and column S7, and the theoretical brightness value of the sub-pixel in row G4 and column S13 are also used.

Preferably, in the second implementation provided by the present invention, in step S2, the actual brightness of the sub-pixel in row m and column n is calculated according to the following formula (4):

$$A(m,n) = a*T(m,n-3) + \left(b + \sum_{i=1}^{4} e_i\right)*T(m,n) + a*T(m,n+3) - [e_1*T(m-1,n-3) + e_2*T(m+1,n-3) + e_3*T(m-1,n+3) + e_4*T(m+1,n+3)] \quad (4)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, $1<m<X$, $3<n\leq Y-3$, $a>0$, $b>0$, $e_i>0$, $2a+b=1$, and $$\sum_{i=1}^{4} e_i \leq 0.4.$$

FIG. 3 illustrates value matrices of $e_i$. It should be understood that, negative values in the matrices shown in FIG. 3 mean that a minus is added before $e_i$, and $e_i$ times the theoretical brightness value of a corresponding sub-pixel is subtracted. Taking FIG. 3(1) as an example, a value of $e_1$ corresponding to the sub-pixel in row G2 and column S7 is 0.02, a value of $e_2$ corresponding to the sub-pixel in row G4 and column S7 is 0.02, a value of $e_3$ corresponding to the sub-pixel in row G2 and column S13 is 0.02, and a value of $e_4$ corresponding to the sub-pixel in row G4 and column S13 is 0.02. The ranges of a and b are the same as those in the first implementation, for example, in the present implementation, b may have a value of 0.7, and a may have a value of 0.15.

Therefore, A(3, 10)=0.15*T(3, 7)+0.78*T(3, 10)+0.15*T(3, 10)−0.02*[T(2, 7)+T(4, 7)+T(2, 13)+T(4, 13)].

In the above specific implementation, values of $e_1$, $e_2$, $e_3$, $e_4$ are the same, and all equal to 0.02. It should be understood that values of $e_1$, $e_2$, $e_3$, $e_4$ may be different from one another, as long as $$\sum_{i=1}^{4} e_i \leq 0.4$$

is satisfied. Although various possible values of $e_1$, $e_2$, $e_3$, $e_4$ are given in FIGS. 3(1) to 3(9), it should be understood by a person skilled in the art that ranges of $e_1$, $e_2$, $e_3$, $e_4$ are not limited thereto.

When the theoretical brightness values of respective sub-pixels in the pixel array are calculated by using the algorithm provided by the present implementation, the middle sub-pixels are sub-pixels from the second row (including the second row) to the penultimate row (including the penultimate row) and from the fourth column (including the fourth column) to the fourth-last column. (including the fourth-last column). The boundary sub-pixels are the first row of sub-pixels, the last row of sub-pixels, the first three columns of sub-pixels and the last three columns of sub-pixels. Similar to the first implementation of the present invention, formula (4) provided by the second implementation of the present invention can be used for calculating the actual brightness values of the middle sub-pixels, i.e., sub-pixels other than the first three columns of sub-pixels, the last three columns of sub-pixels, the first row of sub-pixels and the last row of sub-pixels, in the pixel array. Similarly, the pixel array has far more than one row and far more than three columns, and thereby inputting theoretical brightness values to the first three columns of sub-pixels, the last three columns of sub-pixels, the first row of sub-pixels and the last row of sub-pixels has little influence on the entirety of the display panel including the pixel array.

In order to reduce the overall granular sensation of the display panel including the pixel array, preferably, the actual brightness values of the boundary sub-pixels may be calculated by using the following formulae (5) to (12).

When $1<m<X$ and $n\leq 3$ (i.e., sub-pixels from the second row to the penultimate row in the first three columns), the brightness of each sub-pixel is calculated by using the theoretical brightness value T(m, n+3) of the sub-pixel in row m and column n+3, the theoretical brightness value T(m−1, n+3) of the sub-pixel in row m−1 and column n+3, and the theoretical brightness value T(m+1, n+3) of the sub-pixel in row m+1 and column n+3 in addition to the theoretical brightness value T(m, n) of the sub-pixel per se. For example, the actual brightness values of sub-pixels of respective rows in the first three columns may be calculated by using the following formula (5):

$$A(m,n)(c+f_1+f_2)*T(m,n)+d*T(m,n+3)-[f_1*T(m-1,n+3)+f_2*T(m+1,n+3)] \quad (5)$$

wherein, $c>0$, $d>0$, $f_1>0$, $f_2>0$, $f_1+f_2\leq 4$, and $c+d=1$.

Correspondingly, when $1<m<X$ and $n>Y-3$ (i.e., sub-pixels from the second row to the penultimate row in the last three columns), the actual brightness values of sub-pixels of respective rows in the last three columns are calculated by using the following formula (6):

$$A(m,n)=(c+g_1+g_2)*T(m,n-3)+d*T(m,n-3)-[*T(m-1,n-3)+g_2*T(m+1,n-3)] \quad (6)$$

wherein, $c>0$, $d>0$, $g_1>0$, $g_2>0$, $g_b+g_2\leq 0.4$, and $c+d=1$.

When $m=1$ and $3<n\leq Y-3$, the actual brightness values of sub-pixels from the fourth column to column (Y−3) in the first row are calculated by using the following formula (7):

$$A(m,n)=a*T(m,n-3)+(b+h_1+h_2)*T(m,n)+a*T(m,n+3)-[h_1*T(m+1,n-3)+h_2*T(m+1,n+3)] \quad (7)$$

wherein, $a>0$, $b>0$, $h_1>0$, $h_2>0$, $2a+b=1$, and $h_1+h_2\leq 0.4$.

When $m-1$ and $n\leq 3$, the actual brightness values of sub-pixels of the first three columns in the first row are calculated by using the following formula (8):

$$A(m,n)=(b+j)*T(m,n)+a*T(m,n+3)-j*T(m+1,n+3) \quad (8)$$

wherein, $a>0$, $b>0$, $j>0$, $a+b=1$, and $j\leq 10.4$.

When $m=1$ and $n>Y-3$, the actual brightness values of sub-pixels of the last three columns in the first row are calculated by using the following formula (9):

$$A(m,n)=(c+k)*T(m,n)+d*T(m,n-3)-k*T(m+1,n-3) \quad (9)$$

wherein, $c>0$, $d>0$, $k>0$, $k\leq 0.4$ and $c+d=1$.

When m=X and 3<n≤Y−3, the actual brightness values of sub-pixels from the fourth column to column (Y−3) in row X (i.e., the last row) are calculated by using the following formula (10):

$$A(m,n)=a*T(m,n-3)+(b+L_1+L_2)*T(m,n)+a*T(m,n+3)-[L_1*T(m-1,n-3)+L_2T(m-1,n+3)] \quad (10)$$

wherein, a>0, b>0, $L_1$>0, $L_2$>0, 2a+b=1, and $L_1+L_2 \leq 0.4$.

When m=X and n≤3, the actual brightness values of sub-pixels of the first three columns in row X (i.e., the last row) are calculated by using the following formula (11):

$$A(m,n)=(b+m_1)*T(m,n)+a*T(m,n+3)-m_1*T(m-1,n+3) \quad (11)$$

wherein, a>0, b>0, $m_1$>0, a+b=1, and $m_1 \leq 0.4$.

When m=X and n>Y−3, the actual brightness values of sub-pixels of the last three columns in row X (i.e., the last row) are calculated by using the following formula (12):

$$A(m,n)=(b+n_1)*T(m,n)+a*T(m,n-3)-n_1*T(m-1,n<3) \quad (12)$$

wherein, a>0, b>0, g>0, a+b=1, and $n_1 \leq 10.4$.

When calculating the actual brightness of the boundary sub-pixels by using the above formulae (5) to (12), in addition to the theoretical brightness value of one sub-pixel per se, the theoretical brightness value(s) of sub-pixel(s) adjacent thereto in the same color as said one sub-pixel in the same row (hereinafter referred to as same-row sub-pixel(s) for short) and the theoretical brightness value(s) of sub-pixel(s) in the same color as said one sub-pixel in a different row (hereinafter referred to as different-row sub-pixel(s) for short) are also needed. Here, a correction factor of said one sub-pixel includes two parts, i.e., a same-row correction factor and a different-row correction factor. The same-row correction factor should satisfy the condition that a sum of the same-row correction factor and the correction factor(s) of the same-row sub-pixel(s) is equal to 1, and the different-row correction factor should satisfy the condition that the different-row correction factor is equal to a sum of the correction factors of the different-row sub-pixels and the different-row correction factor is no larger than 0.4.

Taking formula (5) as an example, when calculating the actual brightness value of the sub-pixel in row m and column n, the same-row sub-pixel that needs to be used is the sub-pixel in row m and column n+3, and the different-row sub-pixels that need to be used are the sub-pixel in row m−1 and column n+3 and the sub-pixel in row m+1 and column n+3. The same-row correction factor of the theoretical brightness value T(m, n) of the sub-pixel in row m and column n is c, the different-row correction factor of the theoretical brightness value T(m, n) of the sub-pixel in row m and column n is $f_1+f_2$, the correction factor of the same-row sub-pixel is d, and the correction factors of the different-row sub-pixels are $f_1$ and $f_2$.

The same-row correction factor of the sub-pixel in row m and column n satisfies: c+d=1, and the different-row correction factor of the sub-pixel in row m and column n satisfies: $f_1+f_2 \leq 0.4$.

It should be understood that, in different formulas, parameters represented by the same letter may have the same value, or may have different values, as long as the conditions of the respective formulae are satisfied. For example, values of parameters a and b in formula (7) may be the same as or different from values of parameters a and b in formula (10), as long as 2a+b=1 is satisfied.

In the third preferable implementation of the present invention shown in FIG. 4, in step S2, the actual brightness value of the sub-pixel in row m and column n is calculated according to the following formula (13):

$$A(m,n)=a*T(m,n-3)+\left(b+\sum_{i=1}^{6} f_i\right)*T(m,n)+a*T(m,n+3)-[f_1*T(m-1,n-3)+f_2*T(m-1,n+3)+f_3*T(m+1,n-3)+f_4*T(m+1,n+3)+f_5*T(m-1,n)+f_5*T(m+1,n)] \quad (13)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, T(m+1, n) is the theoretical brightness value of the sub-pixel in row m+1 and column n, T(m−1, n) is the theoretical brightness value of the sub-pixel in row m−1 and column n, 1<m<X, 3<n≤Y−3, a>0, b>0, f>0, 2a+b−1, and $$\sum_{i=1}^{6} f_i \leqslant 0.4.$$

FIG. 5 illustrates value matrices of $f_1$. It should be understood that, negative values in the matrices shown in FIG. 5 mean that a minus is added before $f_i$, and $f_i$ is subtracted. Taking FIG. 5(1) as an example, a value of $f_1$ corresponding to the sub-pixel in row G2 and column S7 is 0.02, a value of $f_2$ corresponding to the sub-pixel in row G2 and column S13 is 0.02, a value of $f_3$ corresponding to the sub-pixel in row G4 and column S7 is 0.02, a value of $f_4$ corresponding to the sub-pixel in row G4 and column S13 is 0.02, a value of $f_5$ corresponding to the sub-pixel in row G2 and column S10 is 0.02 and a value of $f_6$ corresponding to the sub-pixel in row G4 and column S10 is 0.02. The ranges of a and b are the same as those in the first implementation, for example, in the present implementation, b may have a value of 0.7, and a may have a value of 0.15.

Like the above two implementations of the present invention, formula (13) provided by the third implementation of the present invention can be used for calculating the actual brightness values of the sub-pixels other than the first three columns of sub-pixels, the last three columns of sub-pixels, the first row of sub-pixels and the last row of sub-pixels, in the pixel array. Similarly, the pixel array has far more than one row and far more than three columns, and thereby inputting theoretical brightness values to the first three columns of sub-pixels, the last three columns of sub-pixels, the first row of sub-pixels and the last row of sub-pixels has little influence on the entirety of the display panel including the pixel array.

In order to reduce the overall granular sensation of the display panel including the pixel array, preferably, the actual brightness values of the first three columns of sub-pixels, the last three columns of sub-pixels, the first row of sub-pixels and the last row of sub-pixels may be calculated by using the following formulae (14) to (21).

When 1<m<X and n≤3 (i.e., sub-pixels from the second row to the penultimate row in the first three column(s), the brightness of each sub-pixel is calculated by using the theoretical brightness value T(m, n+3) of the sub-pixel in row m and column n+3, the theoretical brightness value T(m−1, n+3) of the sub-pixel in row m−1 and column n+3, and the theoretical brightness value T(m+1, n+3) of the sub-pixel in row m+1 and column n+3 in addition to the theoretical brightness value T(m, n) of the sub-pixel per se. For example, the actual brightness values of sub-pixels from the second row to the penultimate row in the first three columns may be calculated by using the following formula (14):

$$A(m,n)=\left(c+\sum_{i=1}^{4}g_i\right)*T(m,n)+d*T(m,n+3)-[g_1*T(m-1,n+3)+g_2*T(m+1,n+3)+g_3*T(m-1,n)+g_4*T(m+1,n)] \quad (14)$$

$$\text{wherein, } c>0,\ d>0,\ g_i>0,\ \sum_{i=1}^{4}g_i\leq 0.4, \text{ and } c+d=1.$$

When 1<m<X and n>Y−3, the actual brightness values of sub-pixels from the second row to the penultimate row in the last three columns may be calculated by using the following formula (15):

$$A(m,n)=\left(c+\sum_{i=1}^{4}H_i\right)*T(m,n)+d*T(m,n-3)-[H_1*T(m-1,n-3)+H_2*T(m+1,n-3)+H_3*T(m-1,n)+H_4*T(m+1,n)] \quad (15)$$

$$\text{wherein, } c>0,\ d>0,\ h_i>0,\ \sum_{i=1}^{4}H_i\leq 0.4, \text{ and } c+d=1.$$

When m−1 and 3<n>Y−3, the actual brightness values of sub-pixels from the fourth column to the fourth-last column in the first row may be calculated by using the following formula (16):

$$A(m,n)=a*T(m,n-3)+\left(b+\sum_{i=1}^{3}j_3\right)*T(m,n)+a*T(m,n+3)-[j_1*T(m+1,n-3)+j_2*T(m+1,n+3)+j_3*T(m+1,n)] \quad (16)$$

$$\text{wherein, } a>0,\ b>0,\ j_i>0,\ 2a+b=1, \text{ and } \sum_{i=1}^{3}j_3\leq 0.4.$$

When m=1 and the actual brightness values of sub-pixels of the first three columns in the first row may be calculated by using the following formula (17):

$$A(m,n)=(b+k_1+k_2)*T(m,n)+a*T(m,n+3)-[k_1*T(m+1,n+3)-k_2*T(m+1,n)] \quad (17)$$

wherein, a>0, b>0, $k_1$>0, $k_2$>0, a+b=1, and $k_b+k_2\leq 0.4$.

When m=1 and n>Y−3, the actual brightness values of sub-pixels of the last three columns in the first row may be calculated by using the following formula (18):

$$A(m,n)=(c+L_1+L_2)*T(m,n)+d*T(m,n-3)-[L_1*T(m+1,n-3)+L_2*T(m+1,n)] \quad (18)$$

wherein, c>0, d>0, $L_1$>0, $L_2$>0, $L_1+L_2\leq 0.4$ and c+d=1.

When m=X and 3<n≤Y−3, the actual brightness values of sub-pixels from the fourth column to the fourth-last column in the last row may be calculated by using the following formula (19):

$$A(m,n)=a*T(m,n-3)+\left(b+\sum_{i=1}^{3}M_i\right)*T(m,n)+a*T(m,n+3)-[M_1*T(m-1,n-3)+M_2*T(m-1,n+3)+M_3*T(m-1,n)] \quad (19)$$

$$\text{wherein, } a>0,\ b>0,\ m_i>0,\ 2a+b=1, \text{ and } \sum_{i=1}^{3}M_i\leq 0.4.$$

When m=X and n≤3, the actual brightness values of sub-pixels of the first three columns in the last row may be calculated by using the following formula (20):

$$A(m,n)=(b+N_1N_2)*T(m,n)+a*T(m,n+3)-[N_1*T(m-1,n+3)+N_2*T(m-1,n)] \quad (20)$$

wherein, a>0, b>0, $N_1$>0, $N_2$>0, a+b=1, and $N_1+N_2\leq 0.4$.

When m=X and n>Y−3, the actual brightness values of sub-pixels of the last three columns in the last row may be calculated by using the following formula (21):

$$A(m,n)=(b+o_1+o_2)*T(m,n)+a*T(m,n-3)-[o_1*T(m-1,n-3)+o_2*T(m-1,n)] \quad (21)$$

wherein, a>0, b>0, $o_1$>0, $o_2$>0, a+b=1, and $o_1+o_2\leq 0.4$.

Like the second implementation, when calculating the actual brightness of the boundary sub-pixels by using the above formulae (14) to (21), in addition to the theoretical brightness value of one sub-pixel per se, the theoretical brightness value(s) of sub-pixel(s) adjacent thereto in the same color as said one sub-pixel in the same row (hereinafter referred to as same-row sub-pixel(s) for short) and the theoretical brightness value(s) of sub-pixel(s) in the same color as said one sub-pixel in a different row (hereinafter referred to as different-row sub-pixel(s) for short) are also needed. Here, a correction factor of said one sub-pixel includes two parts, i.e., a same-row correction factor and a different-row correction factor. The same-row correction factor should satisfy the condition that a sum of the same-row correction factor and the correction factor(s) of the same-row sub-pixel(s) is equal to one, and the different-row correction factor should satisfy the condition that the different-row correction factor is equal to a sum of the correction factors of the different-row sub-pixels and the different-row correction factor is no larger than 0.4.

Taking formula (14) as an example, when calculating the actual brightness value of the sub-pixel in row m and column n, the same-row sub-pixel that needs to be used is the sub-pixel in row m and column n+3, and the different-row sub-pixels that need to be used are the sub-pixel in row m−1 and column n+3, the sub-pixel in row m−1 and column n, the sub-pixel in row m+1 and column n+3 and the sub-pixel in row m+1 and column n. The same-row correction factor of the theoretical brightness value T(m, n) of the sub-pixel in row m and column n is c, the different-row correction factor of the theoretical brightness value T(m, n) of the sub-pixel in row m and column n is $$\sum_{i=1}^{4}g_i,$$

the correction factor of the same-row sub-pixel is d, and the correction factors of the different-row sub-pixels are $g_1$ to $g_4$. The same-row correction factor of the sub-pixel in row m and column n satisfies: c+d=1, and the different-row correction factor of the sub-pixel in row m and column n satisfies:

$$\sum_{i=1}^{4} g_i \leq 0.4.$$

In the fourth preferable implementation of the present invention shown in FIG. 6, the pixel array comprises X rows and Y columns of sub-pixels, and in step S2, the actual brightness value of the sub-pixel in row m and column n is calculated according to the following formula (22):

$$A(m, n) = a * T(m, n-3) + \left(b + \sum_{i=1}^{6} g_i\right) * T(m, n) + a * T(m, n+3) - [g_1 * T(m-1, n-3) + g_2 * T(m+1, n-3) + g_3 * T(m-1, n+3) + g_4 * T(m+1, n+3) + g_5 * T(m-2, n) + g_6 * T(m+2, n)] \quad (22)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, T(m+2, n) is the theoretical brightness value of the sub-pixel in row m+2 and column n, T(m−2, n) is the theoretical brightness value of the sub-pixel in row m−2 and column n, 2<m≤X−2, 3<n≤Y−3, a>0, b>0, $g_i$>0, 2a+b=1, and $$\sum_{i=1}^{6} g_i \leq 0.4.$$

FIG. 7 illustrates value matrices of $g_i$. It should be understood that, negative values in the matrices shown in FIG. 7 mean that a minus is added before $g_i$, and $g_i$ is subtracted. Taking FIG. 7(1) as an example, a value of $g_i$ corresponding to the sub-pixel in row G2 and column S7 is 0.02, a value of $g_2$ corresponding to the sub-pixel in row G4 and column S7 is 0.02, a value of $g_3$ corresponding to the sub-pixel in row G2 and column S13 is 0.02, a value of $g_4$ corresponding to the sub-pixel in row G4 and column S13 is 0.02, a value of $g_5$ corresponding to the sub-pixel in row G1 and column S10 is 0.02 and a value of $g_6$ corresponding to the sub-pixel in row G5 and column S10 is 0.02. The ranges of a and b are the same as those in the first implementation, for example, in the present implementation, b may have a value of 0.7, and a may have a value of 0.15.

Similar to the above three implementations of the present invention, formula (22) provided by the fourth implementation of the present invention can be used for calculating the actual brightness values of the sub-pixels other than the first three columns of sub-pixels, the last three columns of sub-pixels, the first two rows of sub-pixels and the last two rows of sub-pixels, in the pixel array. Similarly, the pixel array has far more than two rows and far more than three columns, and thereby inputting theoretical brightness values to the first three columns of sub-pixels, the last three columns of sub-pixels, the first two rows of sub-pixels and the last two rows of sub-pixels has little influence on the entirety of the display panel including the pixel array.

In order to reduce the overall granular sensation of the display panel including the pixel array, preferably, the actual brightness values of the first three columns of sub-pixels, the last three columns of sub-pixels, the first two rows of sub-pixels and the last two rows of sub-pixels may be calculated by using the following formulae (23) to (36).

When 2<m≤X−2 and n≤3, the actual brightness values of sub-pixels from the third row to the third-last row in the first three columns may be calculated by using the following formula (23):

$$A(m, n) = \left(c + \sum_{i=1}^{4} H_i\right) * T(m, n) + d * T(m, n+3) - [H_1 * T(m-1, n+3) + H_2 * T(m+1, n+3) + H_3 * T(m-2, n) + H_4 * T(m+2, n)] \quad (23)$$

wherein, $c > 0$, $d > 0$, $g > 0$, $H_i > 0$, $c + d = 1$ and $\sum_{i=1}^{4} H_i \leq 0.4$.

When 2<m≤X−2 and n>Y−3, the actual brightness values of sub-pixels from the third row to the third-last row in the last three columns may be calculated by using the following formula (24):

$$A(m, n) = \left(c + \sum_{i=1}^{4} j_i\right) * T(m, n) + d * T(m, n-3) - [j_1 * T(m-1, n-3) + j_2 * T(m+1, n-3) + j_3 * T(m-2, n) + j_4 * T(m+2, n)] \quad (24)$$

wherein, $c > 0$, $d > 0$, $j_i > 0$, $\sum_{i=1}^{4} j_i \leq 0.4$, and $c + d = 1$.

When m=2 and 3<n≤Y−3, the actual brightness values of sub-pixels from the fourth column to the fourth-last column in the second row may be calculated by using the following formula (25):

$$A(m, n) = a * T(m, n-3) + \left(b + \sum_{i=1}^{5} k_i\right) * T(m, n) + a * T(m, n+3) - [k_1 * T(m-1, n-3) + k_2 * T(m+1, n-3) + k_3 * T(m-1, n+3) + k_4 * T(m+1, n+3) + k_5 * T(m+2, n)] \quad (25)$$

wherein, $a > 0$, $b > 0$, $k_i > 0$, $2a + b = 1$, and $\sum_{i=1}^{5} k_i \leq 0.4$.

When m=1 and 3<n≤Y−3, the actual brightness values of sub-pixels from the fourth column to the fourth-last column in the first row may be calculated by using the following formula (26):

$$A(m,n)=a*T(m,n-3)+\left(b+\sum_{i=1}^{3}L_i\right)*T(m,n)+a*T(m,n+3)-[L_1*T(m+1,n-3)+L_2*T(m+1,n+3)+L_3*T(m+2,n)] \quad (26)$$

wherein, $a>0$, $b>0$, $L_i>0$, $2a+b=1$, and $\sum_{i=1}^{3}L_i\leqslant 0.4$.

When m=2 and n≤3, the actual brightness values of sub-pixels of the first three columns in the second row may be calculated by using the following formula (27):

$$A(m,n)=\left(b+\sum_{i=1}^{3}M_i\right)*T(m,n)+a*T(m,n+3)-[M_1*T(m-1,n+3)+M_2*T(m+1,n+3)+M_3*T(m+2,n)] \quad (27)$$

wherein, $a>0$, $b>0$, $M_i>0$, $a+b=1$, and $\sum_{i=1}^{3}M_i\leqslant 0.4$.

When m−1 and n≤3, the actual brightness values of sub-pixels of the first three columns in the first row may be calculated by using the following formula (28):

$$A(m,n)=(b+N_1+N_2)*T(m,n)+a*T(m,n+3)-[N_1*T(m+1,n+3)+N_2*T(m+2,n)] \quad (28)$$

wherein, a>0, b>0, $N_1>0$, $N_2>0$, a+b=1, and $N_1+N_2\leq 0.4$.

When m=2 and n>Y−3, the actual brightness values of sub-pixels of the last three columns in the second row may be calculated by using the following formula (29):

$$A(m,n)=c*T(m,n-3)+\left(d+\sum_{i=1}^{3}o_i\right)*T(m,n)-[o_1*T(m-1,n-3)+o_2*T(m+1,n-3)+o_3*T(m+2,n)] \quad (29)$$

wherein, $c>0$, $d>0$, $o_i>0$, $\sum_{i=1}^{3}o_i\leq 0.4$, and $c+d=1$.

When m=1 and n>Y−3, the actual brightness values of sub-pixels of the last three columns in the first row may be calculated by using the following formula (30):

$$A(m,n)c*T(m,n-3)+(d+o_1+o_2)*T(m,n)-[o_1*T(m+1,n-3)-o_2*T(m+2,n)] \quad (30)$$

wherein, c>0, d>0, $o_1>0$, $o_2>0$, $o_1+o_2\leq 0.4$ and c+d=1.

When m=X−1 and 3<n≤Y−3, the actual brightness values of sub-pixels from the fourth column to the fourth-last column in the second-last row may be calculated by using the following formula (31):

$$A(m,n)=a*T(m,n-3)+\left(b+\sum_{i=1}^{5}p_i\right)*T(m,n)+a*T(m,n+3)-[p_1*T(m-1,n-3)+p_2*T(m+1,n-3)+p_3*T(m-1,n+3)+p_4*T(m+1,n+3)+p_5*T(m-2,n)] \quad (31)$$

-continued wherein, $a>0$, $b>0$, $p_i>0$, $2a+b=1$, and $\sum_{i=1}^{5}p_i\leq 0.4$.

When m=X and 3<n≤Y−3, the actual brightness values of sub-pixels from the fourth column to the fourth-last column in the last row may be calculated by using the following formula (32):

$$A(m,n)=a*T(m,n-3)+\left(b+\sum_{i=1}^{3}q_i\right)*T(m,n)+a*T(m,n+3)-[q_1*T(m-1,n-3)+q_2*T(m-1,n+3)+q_3*T(m-2,n)] \quad (32)$$

wherein, $a>0$, $b>0$, $q_i>0$, $2a+b=1$, and $\sum_{i=1}^{3}q_i\leq 0.4$.

When m=X−1 and n≤3, the actual brightness values of sub-pixels of the first three columns in the second-last row may be calculated by using the following formula (33):

$$A(m,n)=\left(b+\sum_{i=1}^{3}r_i\right)*T(m,n)+a*T(m,n+3)-[r_1*T(m-1,n+3)+r_2*T(m+1,n+3)+r_3*T(m-2,n)] \quad (33)$$

wherein, $a>0$, $b>0$, $r_i>0$, $a+b=1$, and $\sum_{i=1}^{3}r_i\leq 0.4$.

When m=X and n≤3, the actual brightness values of sub-pixels of the first three columns in the last row may be calculated by using the following formula (34):

$$A(m,n)(c+s_1+s_2)*T(m,n)+d*T(m,n+3)-[s_1*T(m-1,n+3)+s_3*T(m-2,n)] \quad (34)$$

wherein, c>0, d>0, $s_1>0$, $s_2>0$, c+d=1, and $s_1+s_2\leq 0.4$.

When m=X−1 and n>Y−3, the actual brightness values of sub-pixels of the last three columns in the second-last row may be calculated by using the following formula (35):

$$A(m,n)=c*T(m,n-3)+\left(d+\sum_{i=1}^{3}t_i\right)*T(m,n)-[t_1*T(m-1,n-3)+t_2*T(m+1,n-3)+t_3*T(m-2,n)] \quad (35)$$

wherein, $c>0$, $d>0$, $t_i>0$, $c+d=1$, and $\sum_{i=1}^{3}t_i\leq 0.4$.

When m=X and n>Y−3, the actual brightness values of sub-pixels of the last three columns in the last row may be calculated by using the following formula (36):

$$A(m,n)=c*T(m,n-3)+(d+u_1+u_2)*T(m,n)-[u_1*T(m-1,n-3)+u_2*T(m-2,n)] \quad (36)$$

wherein, c>0, d>0, $u_1>0$, $u_2>0$, c+d=1 and $u_1+u_2\leq 0.4$.

Like the second and the third implementations, when calculating the actual brightness of the boundary sub-pixels, in addition to the theoretical brightness value of one sub-pixel per se, the theoretical brightness value(s) of sub-pixel(s) adjacent thereto and in the same color as said one sub-pixel in the same row (hereinafter referred to as same-row sub-pixel(s) for short) and the theoretical brightness value(s) of sub-pixel(s) in the same color as said one sub-pixel in a different row (hereinafter referred to as different-row sub-pixel(s) for short) are also needed. The theoretical brightness values of the above sub-pixels involving in the calculation should be multiplied by correction factors. Here, the correction factor of the one sub-pixel includes two parts, i.e., a same-row correction factor and a different-row correction factor. The same-row correction factor should satisfy the condition that a sum of the same-row correction factor and the correction factor(s) of the same-row sub-pixel(s) is equal to one, and the different-row correction factor should satisfy the condition that the different-row correction factor is equal to a sum of the correction factors of the different-row sub-pixels and the different-row correction factor is no larger than 0.4.

Taking formula (23) as an example, when calculating the actual brightness value of the sub-pixel in row m and column n, the same-row sub-pixel that needs to be used is the sub-pixel in row m and column n+3, and the different-row sub-pixels that need to be used are the sub-pixel in row m−1 and column n+3, the sub-pixel in row m+1 and column n+3, the sub-pixel in row m−2 and column n and the sub-pixel in row m+2 and column n. The same-row correction factor of the theoretical brightness value T(m, n) of the sub-pixel in row m and column n is c, the different-row correction factor of the theoretical brightness value T(m, n) of the sub-pixel in row m and column n is $$\sum_{i=1}^{4} H_i,$$

the correction factor of the same-row sub-pixel is d, and the correction factors of the different-row sub-pixels are $H_1$ to $H_4$. The same-row correction factor of the sub-pixel in row m and column n satisfies: c+d=1, and the different-row correction factor of the sub-pixel in row m and column n satisfies:

$$\sum_{i=1}^{4} H_i \leq 0.4.$$

In the fifth preferable implementation of the present invention shown in FIG. 8, the pixel array comprises X rows and Y columns of sub-pixels, and in step S2, the actual brightness value of the sub-pixel in row m and column n is calculated according to the following formula (37):

$$A(m, n) = a * T(m, n-3) + \left(b + \sum_{i=1}^{8} H_i\right) * T(m, n) + a * T(m, n+3) - [H_1 * T(m-1, n-3 + H_2 * T(m+1, n-3) + H_3 * T(m-1, n+3) + H_4 * T(m+1, n+3) + H_5 * T(m-2, n) + H_6 * T(m+2, n) + H_7 * T(m, n-6) + H_8 * T(m, n+6)] \quad (37)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, T(m+2, n) is the theoretical brightness value of the sub-pixel in row m+2 and column n, T(m−2, n) is the theoretical brightness value of the sub-pixel in row m−2 and column n, T(m, n+6) is the theoretical brightness value of the sub-pixel in row m and column n+6, T(m, n−6) is the theoretical brightness value of the sub-pixel in row m and column n−6, $2<m\leq X-2$, $6<n\leq Y-6$, $a>0$, $b>0$, $H_i>0$, 2a+b=1, and $$\sum_{i=1}^{8} H_i \leq 0.4.$$

Figures 9, 10:
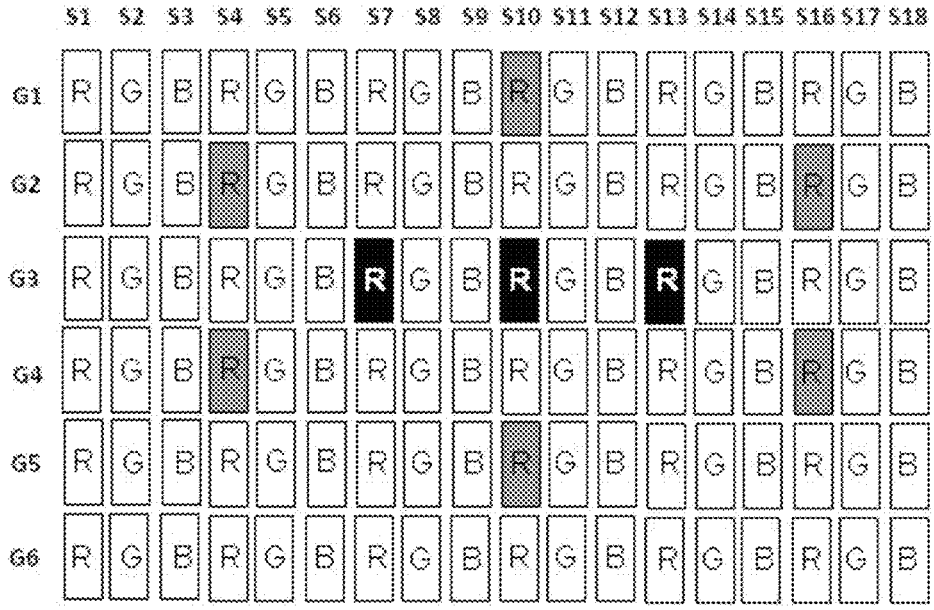
FIG. 9 is an algorithm matrix in calculating actual brightness of the sub-pixel in row G3 and column S10 by using the driving method of a pixel array in the fifth implementation provided by the present invention.
FIG. 10 is a schematic diagram of a distribution of other sub-pixels that are in the same color and need to be used when actual brightness of the sub-pixel in row G3 and column S10 is calculated by using a driving method of a pixel array in the sixth implementation provided by the present invention.

FIG. 9 illustrates value matrices of $H_i$. It should be understood that, negative values in the matrices shown in FIG. 9 mean that a minus is added before $H_i$, and $H_i$ is subtracted. Taking FIG. 9(1) as an example, a value of $H_1$ corresponding to the sub-pixel in row G2 and column S7 is 0.02, a value of $H_2$ corresponding to the sub-pixel in row G4 and column S7 is 0.02, a value of $H_3$ corresponding to the sub-pixel in row G2 and column S13 is 0.02, a value of $H_4$ corresponding to the sub-pixel in row G4 and column S13 is 0.02, a value of $H_5$ corresponding to the sub-pixel in row G1 and column S10 is 0.02, a value of $H_6$ corresponding to the sub-pixel in row G5 and column S10 is 0.02, a value of $H_7$ corresponding to the sub-pixel in row G3 and column S4 is 0.02, and a value of $H_8$ corresponding to the sub-pixel in row G3 and column S16 is 0.02. The ranges of a and b are the same as those in the first implementation, for example, in the present implementation, b may have a value of 0.7, and a may have a value of 0.15.

Formula (37) provided by the fifth implementation of the present invention can be used for calculating the actual brightness values of the sub-pixels other than the first six columns of sub-pixels, the last six columns of sub-pixels, the first two rows of sub-pixels and the last two rows of sub-pixels, in the pixel array. Similarly, the pixel array has far more than two rows and far more than six columns, and thereby inputting theoretical brightness values to the first six columns of sub-pixels, the last six columns of sub-pixels, the first two rows of sub-pixels and the last two rows of sub-pixels has little influence on the entirety of the display panel including the pixel array.

In order to reduce the overall granular sensation of the display panel including the pixel array, preferably, the actual brightness values of the first six columns of sub-pixels, the last six columns of sub-pixels, the first two rows of sub-pixels and the last two rows of sub-pixels may be calculated by using the following method.

When $2<m\leq X-2$ and $n\leq 3$, the actual brightness values of sub-pixels from the third row to the third-last row in the first three columns may be calculated by using the following formula (38):

$$A(m,n)=\left(c+\sum_{i=1}^{5}j_i\right)*T(m,n)+d*T(m,n+3)-[j_1*T(m-1,n+3)+j_2*T(m+1,n+3)+j_3*T(m-2,n)+j_4*T(m+2,n)+j_5*T(m,n+6)] \quad (38)$$

wherein, $$c>0,\ d>0,\ j_1>0,\ c+d=1 \text{ and } \sum_{i=1}^{5}j_i\leqslant 0.4.$$

When 2<m≤X−2 and 3<n≤6, the actual brightness values of sub-pixels from the third row to the third-last row and from the third column to the sixth column may be calculated by using the following formula (39):

$$A(m,n)=a*T(m,n-3)+\left(b+\sum_{i=1}^{7}k_i\right)*T(m,n)+a*T(m,n+3)-[k_1*T(m-1,n-3)k_2*T(m+1,n-3)+k_3*T(m-1,n+3)+k_4*T(m+1,n+3)+k_5*T(m-2,n)+k_6*T(m+2,n)+k_7*T(m,n+6)] \quad (39)$$

wherein, $$a>0,\ b>0,\ k_i>0,\ 2a+b=1 \text{ and } \sum_{i=1}^{7}k_i\leqslant 0.4.$$

When 2<m≤X−2 and Y−6<n≤Y−3, the actual brightness values of sub-pixels from the third row to the third-last row and from the sixth-last column to the third-last column may be calculated by using the following formula (40):

$$A(m,n)=a*T(m,n-3)+\left(b+\sum_{i=1}^{7}L_i\right)*T(m,n)+a*T(m,n+3)-[L_1*T(m-1,n-3)+L_2*T(m+1,n-3)+L_3*T(m-1,n+3)+L_4*T(m+1,n+3)+L_5*T(m-2,n)+L_6*T(m+2,n)+L_7*T(m,n-6)] \quad (40)$$

wherein, $$a>0,\ b>0,\ L_i>0,\ 2a+b=1 \text{ and } \sum_{i=1}^{7}L_i\leqslant 0.4.$$

When 2<m≤X−2 and n>Y−3, the actual brightness values of sub-pixels from the third row to the third-last row in the last three columns may be calculated by using the following formula (41):

$$A(m,n)=c*T(m,n-3)\left(d+\sum_{i=1}^{5}M_i\right)*T(m,n)-[M_1*T(m-1,n-3)+M_2*T(m+1,n-3)+M_3*T(m-2,n)+M_4*T(m+2,n)+M_5*T(m,n-6)] \quad (41)$$

wherein, $$c>0,\ d>0,\ M_i>0,\ c+d=1 \text{ and } \sum_{i=1}^{5}M_i\leqslant 0.4.$$

When m=1 and 6<n≤Y−6, the actual brightness values of sub-pixels from the seventh column to the seventh-last column in the first row may be calculated by using the following formula (42):

$$A(m,n)=a*T(m,n-3)+\left(b+\sum_{i=1}^{5}N_i\right)*T(m,n)+a*T(m,n+3)-[N_1*T(m+1,n-3)+N_2*T(m+1,n+3)+N_3*T(m+2,n)+N_4*T(m,n-6)+N_5*T(m,n+6)] \quad (42)$$

wherein, $$a>0,\ b>0,\ N_i>0,\ 2a+b=1 \text{ and } \sum_{i=1}^{5}N_i\leqslant 0.4.$$

When m=1 and 3<n≤6, the actual brightness values of sub-pixels from the fourth column to the sixth column in the first row may be calculated by using the following formula (43):

$$A(m,n)=a*T(m,n-3)+\left(b+\sum_{i=1}^{4}o_i\right)*T(m,n)+a*T(m,n+3)-[o_1*T(m+1,n-3)+o_2*T(m+1,n+3)+o_3*T(m+2,n)+o_4*T(m,n+6)] \quad (43)$$

wherein, $$a>0,\ b>0,\ o_i>0,\ 2a+b=1 \text{ and } \sum_{i=1}^{4}o_i\leqslant 0.4.$$

When m=1 and n≤3, the actual brightness values of sub-pixels of the first three columns in the first row may be calculated by using the following formula (44):

$$A(m,n)=\left(c+\sum_{i=1}^{3}p_i\right)*T(m,n)+d*T(m,n+3)-[p_1*T(m+1,n+3)+p_2*T(m+2,n)+p_3*T(m,n+6)] \quad (44)$$

wherein, $$c>0,\ d>0,\ p_i>0,\ c+d=1 \text{ and } \sum_{i=1}^{3}p_i\leqslant 0.4.$$

When m=1 and Y−6<n≤Y−3, the actual brightness values of sub-pixels from the sixth-last column to the fourth-last column in the first row may be calculated by using the following formula (45):

$$A(m,n)=a*T(m,n-3)+\left(b+\sum_{i=1}^{4}q_i\right)*T(m,n)+a*T(m,n+3)-[q_1*T(m+1,n-3)+q_2*T(m+1,n+3)+q_3*T(m+2,n)+q_4*T(m,n-6)] \quad (45)$$

-continued wherein, $$a > 0,\ b > 0,\ q_i > 0,\ 2a + b = 1 \text{ and } \sum_{i=1}^{4} q_i \leqslant 0.4.$$

When m=1 and n>Y−3, the actual brightness values of sub-pixels of the last three columns in the first row may be calculated by using the following formula (46):

$$A(m, n) = c * T(m, n-3) + \left(d + \sum_{i=1}^{3} r_i\right) * T(m, n) - [r_1 * T(m+1, n-3) + r_2 * T(m+2, n) + r_3 * T(m, n-6)] \tag{46}$$

wherein, $$c > 0,\ d > 0,\ r_i > 0,\ c + d = 1 \text{ and } \sum_{i=1}^{3} r_i \leqslant 0.4.$$

When m=2 and 6<n≤Y−6, the actual brightness values of sub-pixels from the seventh column to the seventh-last column in the second row may be calculated by using the following formula (47):

$$A(m, n) = a * T(m, n-3) + \left(b + \sum_{i=1}^{7} s_i\right) * T(m, n) + a * T(m, n+3) - [s_1 * T(m-1, n-3) + s_2 * T(m+1, n-3) + s_3 * T(m-1, n+3) + s_4 * T(m+1, n+3) + s_5 * T(m+2, n) + s_6 * T(m, n-6) + s_7 * T(m, n+6)] \tag{47}$$

wherein, $$a > 0,\ b > 0,\ s_i > 0,\ 2a + b = 1 \text{ and } \sum_{i=1}^{7} s_i \leqslant 0.4.$$

When m=2 and 3<n≤6, the actual brightness values of sub-pixels from the fourth column to the sixth column in the second row may be calculated by using the following formula (48):

$$A(m, n) = a * T(m, n-3) + \left(b + \sum_{i=1}^{6} t_i\right) * T(m, n) + a * T(m, n+3) - [t_1 * T(m-1, n-3) + t_2 * T(m+1, n-3) + t_3 * T(m-1, n+3) + t_4 * T(m+1, n+3) + t_5 * T(m+2, n) + t_6 * T(m, n+6)] \tag{48}$$

wherein, $$a > 0,\ b > 0,\ t_i > 0,\ 2a + b = 1 \text{ and } \sum_{i=1}^{6} t_i \leqslant 0.4.$$

When m=2 and n≤3, the actual brightness values of sub-pixels of the first three columns in the second row may be calculated by using the following formula. (49):

$$A(m, n) = \left(c + \sum_{i=1}^{4} u_i\right) * T(m, n) + d * T(m, n+3) - [u_1 * T(m-1, n+3) + u_2 * T(m+1, n+3) + u_3 * T(m+2, n) + u_4 * T(m, n+6)] \tag{49}$$

wherein, $$c > 0,\ d > 0,\ u_i > 0,\ c + d = 1 \text{ and } \sum_{i=1}^{4} u_i \leqslant 0.4.$$

When m=2 and Y<6<n≤Y−3, the actual brightness values of sub-pixels from the sixth-last column to the fourth-last column in the second row may be calculated by using the following formula (50):

$$A(m, n) = a * T(m, n-3) + \left(b + \sum_{i=1}^{6} v_i\right) * T(m, n) + a * T(m, n+3) - [v_1 * T(m-1, n-3) + v_2 * T(m+1, n-3) + v_3 * T(m-1, n+3) + v_4 * T(m+1, n+3) + v_5 * T(m+2, n) + v_6 * T(m, n-6)] \tag{50}$$

wherein, $$a > 0,\ b > 0,\ v_i > 0,\ 2a + b = 1 \text{ and } \sum_{i=1}^{6} v_i \leqslant 0.4.$$

When m=2 and n≥Y−3, the actual brightness values of sub-pixels of the last three columns in the second row may be calculated by using the following formula (51):

$$A(m, n) = c * T(m, n-3) + \left(d + \sum_{i=1}^{4} w_i\right) * T(m, n) - [w_1 * T(m-1, n-3) + w_2 * T(m+1, n-3) + w_3 * T(m+2, n) + w_4 * T(m, n-6)] \tag{51}$$

wherein, $$c > 0,\ d > 0,\ w_i > 0,\ c + d = 1 \text{ and } \sum_{i=1}^{4} w_i \leqslant 0.4.$$

Formulae used to calculate the actual brightness values of sub-pixels of respective columns in the last row are similar to formulae (42) to (46), and the difference therebetween lies in that the theoretical brightness values of the sub-pixels in rows X, X−1, and X−2, instead of the theoretical brightness values of the sub-pixels in rows 1, 2 and 3, need to be used; formulae used to calculate the actual brightness values of sub-pixels of respective columns in the second-last row are similar to formulae (47) to (51), and the difference therebetween lies in that the theoretical brightness values of the sub-pixels in rows X, X−1, X−2 and X−3, instead of the theoretical brightness values of the sub-pixels in rows 1, 2, 3 and 4, need to be used Similar to the second to fourth implementations, when calculating the actual brightness of the boundary sub-pixels, in addition to the theoretical brightness value of one sub-pixel per se, the theoretical brightness value(s) of sub-pixel(s) adjacent thereto and in the same color as said one sub-pixel in the same row (hereinafter referred to as same-row sub-pixel(s) for short) and the theoretical brightness value(s) of sub-pixel(s) in the same color as said one sub-pixel in a different row (hereinafter referred to as different-row sub-pixel(s) for short) are also needed. The theoretical brightness values of the above sub-pixels involving in the calculation should be multiplied by correction factors. Here, the correction factor of the one sub-pixel includes two parts, i.e., a same-row correction factor and a different-row correction factor. The same-row correction factor should satisfy the condition that a sum of the same-row correction factor and the correction factor(s) of the same-row sub-pixel(s) is equal to one, and the different-row correction factor should satisfy the condition that the different-row correction factor is equal to a sum of the correction factors of the different-row sub-pixels and the different-row correction factor is no larger than 0.4.

In the sixth implementation of the present invention shown in FIG. 10, the pixel array comprises X rows and Y columns of sub-pixels, and in step S2, the actual brightness value of the sub-pixel in row m and column n is calculated according to the following formula (52):

$$A(m,n) = a*T(m,n-3) + \left(b + \sum_{i=1}^{6} L_i\right)*T(m,n) + a*T(m,n+3) - [L_1*T(m-1,n-6) + L_2*T(m+1,n-6) + L_3*T(m-1,n+6) + L_4*T(m+1,n+6) + L_5*T(m-2,n) + L_6*T(m+2,n)] \quad (52)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m−1, n−6) is the theoretical brightness value of the sub-pixel in row m−1 and column n−6, T(m−1, n+6) is the theoretical brightness value of the sub-pixel in row m−1 and column n+6, T(m+1, n−6) is the theoretical brightness value of the sub-pixel in row m+1 and column n−6, T(m+1, n+6) is the theoretical brightness value of the sub-pixel in row m+1 and column n+6, T(m−2, n) is the theoretical brightness value of the sub-pixel in row m−2 and column n, T(m+2, n) is the theoretical brightness value of the sub-pixel in row m+2 and column n, $2<m\leq X-2$, $6<n\leq Y-6$, $a>0$, $b>0$, $L_i>0$, $2a+b=1$, and $$\sum_{i=1}^{6} L_i \leq 0.4.$$

FIGS. 11(1) to 11(6) illustrate value matrices of $L_i$. It should be understood that, negative values in the matrices shown in FIG. 11 mean that a minus is added before $L_i$, and $L_i$ is subtracted. Taking FIG. 11(1) as an example, a value of $L_1$ corresponding to the sub-pixel in row G2 and column S4 is 0.02, a value of $L_2$ corresponding to the sub-pixel in row G4 and column S4 is 0.02, a value of $L_3$ corresponding to the sub-pixel in row G2 and column S16 is 0.02, a value of $L_4$ corresponding to the sub-pixel in row G4 and column S16 is 0.02, a value of $L_5$ corresponding to the sub-pixel in row G1 and column S10 is 0.02, and a value of $L_6$ corresponding to the sub-pixel in row G5 and column S10 is 0.02. The a Ages of a and b are the same as those in the first implementation, for example, in the present implementation, b may have a value of 0.7, and a may have a value of 0.15.

Formula (52) provided by the sixth implementation of the present invention can be used for calculating the actual brightness values of the sub-pixels other than the first six columns of sub-pixels, the last six columns of sub-pixels, the first two rows of sub-pixels and the last two rows of sub-pixels, in the pixel array. Similarly, the pixel array has far more than two rows and far more than six columns, and thereby inputting theoretical brightness values to the first six columns of sub-pixels, the last six columns of sub-pixels, the first two rows of sub-pixels and the last two rows of sub-pixels has little influence on the entirety of the display panel including the pixel array.

In order to reduce the overall granular sensation of the display panel including the pixel array, preferably, when calculating the actual brightness values of the first six columns of sub-pixels, the last six columns of sub-pixels, the first two rows of sub-pixels and the last two rows of sub-pixels, it is also necessary to use the theoretical brightness value(s) of the same-row sub-pixel(s) and the theoretical brightness value(s) of the different-row sub-pixel(s). For example, when calculating the actual brightness values of sub-pixels from the seventh column to the seventh-last column in the first row; in addition to the theoretical brightness values of two sub-pixels in the same color and left and right adjacent thereto in the same row, it is also necessary to use the theoretical brightness values of sub-pixels in the same color in the previous row, the next row, and the row immediately above the previous row.

The above formula (52) may also be used to calculate the actual brightness values of the boundary sub-pixels (i.e., the first six columns of sub-pixels, the last six columns of sub-pixels, the first two rows of sub-pixels and the last two rows of sub-pixels). It should be understood that, when any one of the calculated row number and column number is less than or equal to zero, the theoretical brightness values of sub-pixels in this column are set to be zero, and correspondingly, the correction factors corresponding to the theoretical brightness values are also zero. For example, when calculating the actual brightness values of sub-pixels from the seventh column to the seventh-last column in the first row(i.e., m=1 and $6<n\leq Y-6$), $m-1=0$, $n+6\leq Y$, and therefore, all of T(m−1, n−6), T(m−1, n+6), T(m−1, n−6), T(m−2, n), $L_1$, $L_3$, $L_4$ and $L_5$ are equal to zero. In this case, the formula used for calculation of the sub-pixels is equivalent to the following formula (52');

$$A(m,n) = a*T(m,n-3) + \left(b + \sum_{i=1}^{3} j_i\right)*T(m,n) + a*T(m,n+3) - [j_1*T(m+1,n-6) + j_2*T(m+1,n+6) + j_3*T(m+2,n)] \quad (52')$$

wherein, $j_1$ corresponds to $l_2$, $j_2$ corresponds to $l_4$, $j_3$ corresponds to $l_6$, and $$\sum_{i=1}^{3} j_i \leq 0.4.$$

The actual brightness values of the respective boundary sub-pixels may be calculated according to the above method. Since there are various possible cases, and the possible cases have been enumerated in the foregoing embodiments, a person skilled in the art can easily derive the value of the boundary sub-pixels in the present embodiment from the specific cases in the foregoing embodiments, and therefore, calculation methods of the actual brightness values of the respective boundary sub-pixels are not enumerated here. It should be understood that, the calculation methods of the actual brightness values of the respective boundary sub-pixels should also belong to the disclosure of the present invention.

FIG. 12 is a schematic diagram of a distribution of other sub-pixels that are in the same color and need to be used when actual brightness of the sub-pixel in row G4 and column S10 is calculated by using a driving method of a pixel array in the seventh implementation provided by the present invention. In step S2, the actual brightness value of the sub-pixel in row m and column n is calculated according to the following formula (53):

$$A(m,n)=g*T(m,n-6)+h*T(m,n-3)+i*T(m,n)+h*T(m,n+3)+g*T(m,n+6) \quad (53)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m, n−6) is the theoretical brightness value of the sub-pixel in row in and column n−6, T(m, n+6) is the theoretical brightness value of the sub-pixel in row m and column n+6, g>0, h>0, i>0, 2g+2h+i=1, and 6<n≤Y−6.

It can be known that, when calculating the actual brightness value of the sub-pixel in row m and column n, in addition to theoretical brightness value of the sub-pixel in row m and column n, it also necessary to use the theoretical brightness values of other four sub-pixels which are in the same color and have the smallest distance from the sub-pixel in row m and column n in the same row.

It can be easily understood that, the above formula can be directly used to calculate the actual brightness values of sub-pixels from the seventh column to the seventh-last column (i.e., the middle sub-pixels) in the pixel array. When the above formula is used to calculate the actual brightness values of the boundary sub-pixels (i.e., the first six columns of sub-pixels and the last six columns of sub-pixels), namely, if n−6≤0, or n+6>Y, the actual brightness values of this column of sub-pixels are set to be zero, and the correction factors corresponding to this column of sub-pixels are also set to be zero. For example, when calculating the actual brightness values of sub-pixels from the fourth column to the sixth column, both T(m,n−6) and g are zero, and the actual brightness values of sub-pixels from the fourth column to the sixth column may be calculated by using the following formula (54):

$$A(m,n)=h*T(m,n-3)+i*T(m,n)+h*T(m,n+3)+g*T(m,n+6) \quad (54)$$

wherein, 2h+i+g=1.

Similarly, the actual brightness values of sub-pixels in the first three columns may be calculated by using the following formula (55):

$$A(m,n)=i*T(m,n)+h*T(m,n+3)+g*T(m,n+6) \quad (55)$$

wherein, i+h+g=1.

The calculation methods for calculating the actual brightness values of sub-pixels from the sixth-last column to third-last column and the actual brightness values of sub-pixels in the last three columns are similar to the above method. From formulae (53) to (55), a person skilled in the art can easily derive the calculation method for calculating the actual brightness values of the sub-pixels from the sixth-last column to third-last column and the calculation formula for calculating the actual brightness values of the sub-pixels in the last three columns, which are not repeatedly described here.

In the present implementation, specific values of the respective correction factors are not particularly limited, as long as g>0, h>0, i>0 and 2g+2h+i=1 are satisfied.

FIG. 13 is a schematic diagram of a distribution of other sub-pixels that are in the same color and need to be used when actual brightness of the sub-pixel in row G4 and column S10 is calculated by using a driving method of a pixel array in the eighth implementation provided by the present invention. In this implementation, the pixel array comprises X rows and Y columns of sub-pixels, and in step S2, the actual brightness value of the sub-pixel in row m and column n is calculated according to the following formula (56):

$$\begin{aligned} A(m,n) = {} & g*T(m,n-6)+h*T(m,n-3)+\left(i+\sum_{i=1}^{6} M_i\right)*T(m,n)+ \\ & h*T(m,n+3)+g*T(m,n+6)-[M_1*T(m-1,n-3)+ \\ & M_2*T(m-1,n+3)+M_3*T(m+1,n-3)+ \\ & M_4*T(m+1,n+3)+M_5*T(m-1,n)+M_6*T(m+1,n)] \end{aligned} \quad (56)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m, n−6) is the theoretical brightness value of the sub-pixel in row m and column n−6, T(m, n+6) is the theoretical brightness value of the sub-pixel in row m and column n+6, g>0, h>0, i>0, $M_i \geq 0$, 2g+2h+i=1, $$0 < \sum_{i=1}^{6} M_i \leq 0.4,$$

6<n≤Y−6 and 1<m<X.

When 6<n≤Y−6 and 1<m<X (sub-pixels from the seventh column to seventh-last column and from the second row to the second-last row), the above formula may be directly used to calculate the actual brightness values of the respective sub-pixels.

FIG. 14 illustrates value matrices of $M_i$. It should be understood that, negative values in the matrices shown in FIG. 14 mean that a minus is added before $M_i$, and $M_i$ times the theoretical brightness value of the corresponding sub-pixel in formula (56) is subtracted. Taking FIG. 14(1) as an example, a value of $M_1$ corresponding to the sub-pixel in row G3 and column S7 is 0.02, a value of $M_2$ corresponding to the sub-pixel in row G3 and column S13 is 0.02, a value of $M_3$ corresponding to the sub-pixel in row G5 and column S7 is 0.02, a value of $M_4$ corresponding to the sub-pixel in row G5 and column S13 is 0.02, a value of $M_5$ corresponding to the sub-pixel in row G3 and column S10 is 0.02, and a value of $M_6$ corresponding to the sub-pixel in row G5 and column S10 is 0.02.

When calculating the actual brightness values of the boundary sub-pixels (i.e., sub-pixels in the first row (m=1), the last row (m=X), the first three columns (n≤3), from the fourth to sixth columns (3<n<7), from the sixth-last to fourth-last columns (Y−6<n≤Y−3) and the last four columns (n≥Y−3)), if the row number m of any one sub-pixel is equal to or smaller than zero, or larger than X, or the column number n of any one sub-pixel is larger than Y, the theoretical brightness value of the sub-pixel is set to be zero, and correspondingly, the correction factor corresponding to the theoretical brightness value is also zero. For example, when m=1 and 6<n≤Y−6, all of $M_1$, T(m−1, n−3), $M_2$, T(m−1,n+3), $M_5$, and T(m−1,n) are zero, and then the actual brightness values of sub-pixels from the seventh column to the seventh-last column in the first row may be calculated by using the following formula (57):

$$A(m,n)=g*T(m,n-6)+h*T(m,n-3)+\left(i+\sum_{i=1}^{3}N_i\right)*T(m,n)+h*T(m,n+3)+g*T(m,n+6)-[N_1*T(m+1,n-3)+N_2*T(m+1,n+3)+N_3*T(m+1,n)] \quad (57)$$

wherein, $N_1$ corresponds to $M_3$, $N_2$ corresponds to $M_4$, $N_3$ corresponds to $M_6$, and $$0<\sum_{i=1}^{3}N_i\leqslant 0.4.$$

Similarly, a person skilled in the art can derive formulae for calculating the other boundary sub-pixels based on the same method, which are not repeatedly described here.

Figures 15, 16:
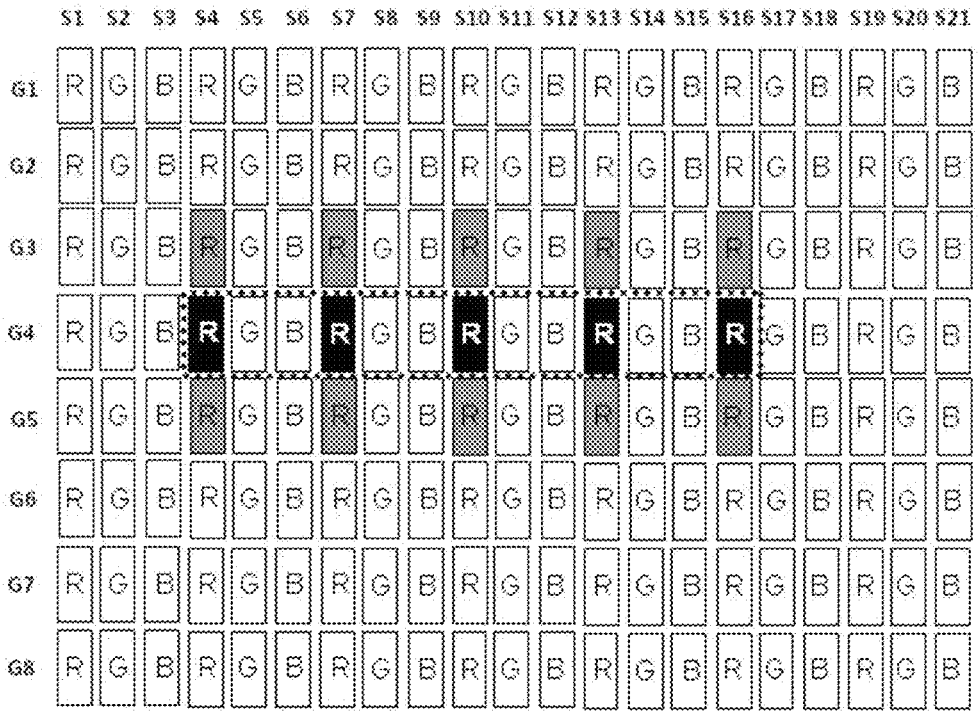
FIG. 15 is a schematic diagram of a distribution of other sub-pixels that are in the same color and need to be used when actual brightness of the sub-pixel in row G4 and column S10 is calculated by using a driving method of a pixel array in the ninth implementation provided by the present invention.
FIG. 16 is an algorithm matrix in calculating actual brightness of the sub-pixel in row G4 and column S10 is calculated with the driving method of a pixel array in the ninth implementation provided by the present invention.

FIG. 15 is a schematic diagram of a distribution of other sub-pixels that are in the same color and need to be used when actual brightness of the sub-pixel in row G4 and column S10 is calculated by using a driving method of a pixel array in the ninth implementation provided by the present invention. In this implementation, the pixel array comprises X rows and Y columns of sub-pixels, and in step S2, the actual brightness value A(m, n) of the sub-pixel in row m and column n is calculated according to the following formula (58):

$$A(m,n)=g*T(m,n-6)+h*T(m,n-3)+\left(i+\sum_{i=1}^{10}N_i\right)*T(m,n)+h*T(m,n+3)+g*T(m,n+6)-[N_1*T(m-1,n-6)+N_2*T(m-1,n-3)+N_3*T(m-1,n)+N_4*T(m-1,n+3)+N_5*T(m-1,n+6)+N_6*T(m+1,n-6)+N_7*T(m+1,n-3)+N_8*T(m+1,n)+N_9*T(m+1,n+3)+N_{10}*T(m+1,n+6)] \quad (58)$$

wherein, T(m, n) is the theoretical brightness value of the sub-pixel in row m and column n, T(m, n−3) is the theoretical brightness value of the sub-pixel in row m, and column n−3, T(m, n+3) is the theoretical brightness value of the sub-pixel in row m and column n+3, T(m, n−6) is the theoretical brightness value of the sub-pixel in row in and column n−6, T(m, n+6) is the theoretical brightness value of the sub-pixel in row m and column n+6, T(m−1, n−6) is the theoretical brightness value of the sub-pixel in row m−1 and column n−6, T(m−1, n−3) is the theoretical brightness value of the sub-pixel in row m−1 and column n−3, T(m−1, n) is the theoretical brightness value of the sub-pixel in row m−1 and column n, T(m−1, n+3) is the theoretical brightness value of the sub-pixel in row m−1 and column n+3, T(m−1, n+6) is the theoretical brightness value of the sub-pixel in row m−1 and column n+6, T(m+1, n−6) is the theoretical brightness value of the sub-pixel in row m+1 and column n−6, T(m+1, n−3) is the theoretical brightness value of the sub-pixel in row m+1 and column n−3, T(m+1, n) is the theoretical brightness value of the sub-pixel in row m+1 and column n, T(m+1, n+3) is the theoretical brightness value of the sub-pixel in row m−1 and column n+3, T(m+1, n+6) is the theoretical brightness value of the sub-pixel in row m+1 and column n+6, g>0, h>0, i>0, $N_i$≥0, 2g+2h+i=1, $$0<\sum_{i=1}^{10}N_i\leqslant 0.4,$$

6<n≤Y−6 and 1<m<X.

FIGS. 16(1) to 16(4) illustrate several implementations of value matrices of $N_i$. It should be understood that, negative values in the matrices shown in FIG. 16 mean that a minus is added before $N_i$, which is equivalent to the subtraction of $N_i$ times the theoretical brightness value of the corresponding sub-pixel in formula (58). Taking FIG. 16(1) as an example, a value of $N_1$ corresponding to the sub-pixel in row G3 and column S4 is 0.02, a value of $N_2$ corresponding to the sub-pixel in row G3 and column S7 is 0.02, a value of $N_3$ corresponding to the sub-pixel in row G3 and column S10 is 0.02, a value of $N_4$ corresponding to the sub-pixel in row G3 and column S13 is 0.02, a value of $N_5$ corresponding to the sub-pixel in row G3 and column S16 is 0.02, a value of $N_6$ corresponding to the sub-pixel in row G5 and column S4 is 0.02, a value of $N_7$ corresponding to the sub-pixel in row G5 and column S7 is 0.02, a value of $N_8$ corresponding to the sub-pixel in row G5 and column S10 is 0.02, a value of $N_9$ corresponding to the sub-pixel in row G5 and column S13 is 0.02, and a value of $N_{10}$ corresponding to the sub-pixel in row G5 and column S16 is 0.02.

The above formula (58) can be used to directly calculate the actual brightness values of the middle sub-pixels. When calculating the actual brightness of the boundary sub-pixels (i.e., sub-pixels in the first row (m=1), the last row (m=X), the first three columns (n≤3), from the fourth to sixth columns (3<n<7), from the sixth-last to fourth-last columns (Y−6<n<Y−3) and the last four columns (n≥Y−3)), if the row number m of any one sub-pixel in the above formula (58) is equal to or smaller than zero, or larger than X, or the column number ii of any one sub-pixel is larger than Y, the theoretical brightness value of the sub-pixel is set to be zero, and correspondingly, the correction factor corresponding to the theoretical brightness value is also zero. For example, when m=1 and 6<n≤Y−6, all of $N_1$, T(m−1, n−6), $N_2$, T(m−1, n−3), $N_3$, T(m−1, n), $N_4$, T(m−1,n+3), $N_5$, and T(m−1,n+6) are zero, and then the actual brightness values of sub-pixels from the seventh column to the seventh-last column in the first row may be calculated by using the following formula (59):

$$A(m,n)=g*T(m,n-6)+h*T(m,n-3)+\left(i+\sum_{i=1}^{5}L_i\right)*T(m,n)+h*T(m,n+3)+g*T(m,n+6)-[L_1*T(m+1,n-6)+L_2*T(m+1,n-3)+L_3*T(m+1,n)+L_4*T(m+1,n+3)+L_5*T(m+1,n+6)] \quad (59)$$

wherein, $L_1$ corresponds to $N_6$, $L_2$ corresponds to $N_7$, $L_3$ corresponds to $N_8$, $L_4$ corresponds to $N_9$, $L_5$ corresponds to $N_{10}$, and $$0<\sum_{i=1}^{5}L_i\leqslant 0.4.$$

A person skilled in the art can derive formulae for calculating the actual brightness values of the other boundary sub-pixels from formulae (58) and (59), which are not repeatedly described here.

Figures 17, 18:
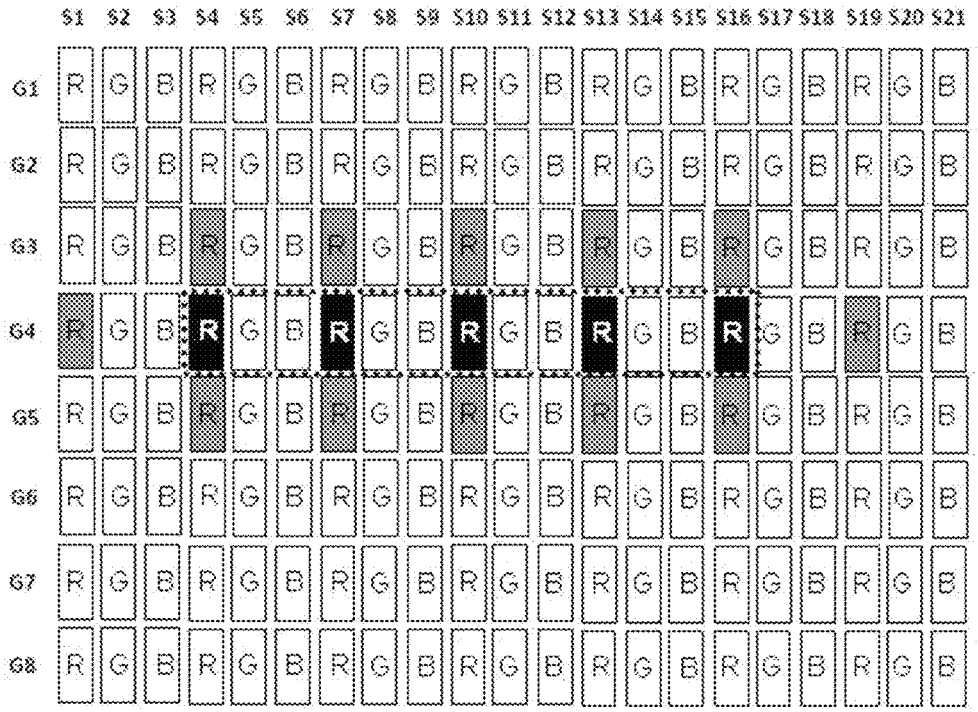
FIG. 17 is a schematic diagram of a distribution of other sub-pixels that are in the same color and need to be used when actual brightness of the sub-pixel in row G4 and column S10 is calculated by using a driving method of a pixel array in the tenth implementation provided by the present invention.
FIG. 18 is an algorithm matrix in calculating actual brightness of the sub-pixel in row G4 and column S10 by using the driving method of a pixel array in the tenth implementation provided by the present invention.

FIG. 17 is a schematic diagram of a distribution of other sub-pixels that are in the same color and need to be used when actual brightness of the sub-pixel in row G4 and column S10 is calculated by using a driving method of a pixel array in the tenth implementation provided by the present invention. In this implementation, the pixel array comprises X rows and Y columns of sub-pixels, and in step S2, the actual brightness value A(m, n) of the sub-pixel in row m and column n is calculated according to the following formula (60):

$$A(m,n)=g*T(m,n-6)+h*T(m,n-3)+\left(i+\sum_{i=1}^{12}o_i\right)*T(m,n)+h*T(m,n+3)+g*T(m,n+6)-[o_1*T(m-1,n-6)+o_2*T(m-1,n-3)+o_3*T(m-1,n)+o_4*T(m-1,n+3)+o_5*T(m-1,n+6)+o_6*T(m+1,n-6)+o_7*T(m+1,n-3)+o_8*T(m+1,n)+o_9*T(m+1,n+3)+o_{10}*T(m+1,n+6)+o_{11}*T(m,n-9)+o_{12}*T(m,n+9)] \quad (60)$$

wherein, T(m, n) is the theoretical brightness value of the sub-pixel in row m and column n, T(m, n−3) is the theoretical brightness value of the sub-pixel in row m and column n−3, T(m, n+3) is the theoretical brightness value of the sub-pixel in row m and column n+3, T(m, n−6) is the theoretical brightness value of the sub-pixel in row m and column n−6, T(m, n+6) is the theoretical brightness value of the sub-pixel in row m and column n+6, T(m, n+9) is the theoretical brightness value of the sub-pixel in row m and column n+9, T(m, n−9) is the theoretical brightness value of the sub-pixel in row m and column n−9, T(m−1, n−6) is the theoretical brightness value of the sub-pixel in row m−1 and column n−6, T(m−1, n−3) is the theoretical brightness value of the sub-pixel in row m−1 and column n−3, T(m−1, n) is the theoretical brightness value of the sub-pixel in row m−1 and column n, T(m−1, n+3) is the theoretical brightness value of the sub-pixel in row m−1 and column n+3, T(m−1, n+6) is the theoretical brightness value of the sub-pixel in row m−1 and column n+6, T(m+1, n−6) is the theoretical brightness value of the sub-pixel in row m+1 and column n−6, T(m+1, n−3) is the theoretical brightness value of the sub-pixel in row m+1 and column n−3, T(m+1, n) is the theoretical brightness value of the sub-pixel in row m+1 and column n, T(m+1, n+3) is the theoretical brightness value of the sub-pixel in row m+1 and column n+3, T(m+1, n+6) is the theoretical brightness value of the sub-pixel in row m+1 and column n+6, g>0, h>0, i>0, $o_i\geq 0$, 2g+2h+i=1, $$0<\sum_{i=1}^{12}o_i\leqslant 0.4,$$

9<n≤Y−9 and 1<m<X.

FIGS. 18(1) to 18(4) illustrate several implementations of value matrices of $o_i$. It should be understood that, negative values in the matrices shown in FIG. 18 mean that a minus is added before $o_i$, which is equivalent to and subtraction of $o_i$ times the theoretical brightness value of the corresponding sub-pixel in formula (60). Taking FIG. 18(1) as an example, a value of $o_1$ corresponding to the sub-pixel in row G3 and column S4 is 0.02, a value of $o_2$ corresponding to the sub-pixel in row G3 and column S7 is 0.02, a value of $o_3$ corresponding to the sub-pixel in row G3 and column S10 is 0.02, a value of $o_4$ corresponding to the sub-pixel in row G3 and column S13 is 0.02, a value of $o_5$ corresponding to the sub-pixel in row G3 and column S16 is 0.02, a value of $o_6$ corresponding to the sub-pixel in row G5 and column S4 is 0.02, a value of $o_7$ corresponding to the sub-pixel in row G5 and column S7 is 0.02, a value of $o_8$ corresponding to the sub-pixel in row G5 and column S10 is 0.02, a value of $o_9$ corresponding to the sub-pixel in row G5 and column S13 is 0.02, a value of $o_{10}$ corresponding to the sub-pixel in row G5 and column S16 is 0.02, a value of $o_{11}$ corresponding to the sub-pixel in row G4 and column S1 is 0.02, and a value of $o_{12}$ corresponding to the sub-pixel in row G4 and column S19 is 0.02.

The above formula (60) can be used to directly calculate the actual brightness values of the middle sub-pixels. When calculating the actual brightness of the boundary sub-pixels (i.e., sub-pixels in the first row (m=1), the last row (m=X), the first three columns (n≤3), from the fourth to sixth columns (3<n<7), from the sixth-last to fourth-last columns (Y−6<n<Y−3) and the last four columns (n≥Y−3)), if the row number m of any one sub-pixel in the above formula (60) is equal to or smaller than zero, or larger than X, or the column number n of any one sub-pixel is larger than Y, the theoretical brightness value of the sub-pixel is set to be zero, and correspondingly; the correction factor corresponding to the theoretical brightness value is also zero. For example, when m=1 and 9<n≤Y−9, all of $o_1$, T(m−1, n−6), $o_2$, T(m−1,n−3), $o_3$, T(m−1,n), $o_4$, T(m−1,n+3), $o_5$, and T(m−1,n+6) are zero, and then the actual brightness values of sub-pixels from the tenth column to the ninth-last column in the first row may be calculated by using the following formula (61):

$$A(m,n)=g*T(m,n-6)+h*T(m,n-3)+\left(i+\sum_{i=1}^{7}p_i\right)*T(m,n)+h*T(m,n+3)+g*T(m,n+6)-[p_1*T(m+1,n-6)+ \quad (61)$$

-continued $$p_2 * T(m+1, n-3) + p_3 * T(m+1, n) + p_4 * T(m+1, n+3) + p_5 * T(m+1, n+6) + p_6 * T(m, n-9) + p_7 * T(m, n+9)]$$

wherein, $p_1$ corresponds to $o_6$, $p_2$ corresponds to $o_7$, $p_3$ corresponds to $o_8$, $p_4$ corresponds to $o_9$, $p_5$ corresponds to $o_{10}$, $p_6$ corresponds to $o_{11}$, $p_7$ corresponds to $o_{12}$, and $$0 < \sum_{i=1}^{7} p_i \leqslant 0.4.$$

Similarly, a person skilled in the art can derive formulae for calculating the actual brightness values of the other boundary sub-pixels based on the same method, which are not repeatedly described here.

FIG. 19 is a schematic diagram of a distribution of other sub-pixels that are in the same color and need to be used when actual brightness of the sub-pixel in row G4 and column S10 is calculated by using a driving method of a pixel array in the eleventh implementation provided by the present invention. In this implementation, the pixel array comprises X rows and Y columns of sub-pixels, and in step S2, the actual brightness value A(m, n) of the sub-pixel in row m and column n is calculated according to the following formula (62):

$$A(m, n) = g * T(m, n-6) + h * T(m, n-3) + \left(i + \sum_{i=1}^{12} p_i\right) * T(m, n) + h * T(m, n+3) + g * T(m, n+6) - [p_1 * T(m, n-9) + p_2 * T(m+1, n-6) + p_3 * T(m+2, n-3) + p_4 * T(m+3, n) + p_5 * T(m+2, n+3) + p_6 * T(m+1, n+3) + p_7 * T(m, n+9) + p_8 * T(m-1, n+6) + p_9 * T(m-2, n+3) + p_{10} * T(m-3, n) + p_{11} * T(m-2, n-3) + p_{12} * T(m-1, n-6)] \quad (62)$$

wherein, T(m, n−6) is the theoretical brightness value of the sub-pixel in row m and column n−6, T(m, n−3) is the theoretical brightness value of the sub-pixel in row m and column n−3, T(m, n) is the theoretical brightness value of the sub-pixel in row m and column n, T(m, n+3) is the theoretical brightness value of the sub-pixel in row m and column n+3. T(m, n+6) is the theoretical brightness value of the sub-pixel in row m and column n+6, T(m, n−9) is the theoretical brightness value of the sub-pixel m and column n−9, T(m+1, n−6) is the theoretical brightness value of the sub-pixel in row m+1 and column n−6, T(m+2, n−3) is the theoretical brightness value of the sub-pixel in row m+2 and column n−3, T(m+3, n) is the theoretical brightness value of the sub-pixel in row m+3 and column n, T(m+2, n+3) is the theoretical brightness value of the sub-pixel in row m+2 and column n+3, T(m+1, n+3) is the theoretical brightness value of the sub-pixel in row m+1 and column n+3. T(m, n+9) is the theoretical brightness value of the sub-pixel in row m and column n+9, T(m−1, n+6) is the theoretical brightness value of the sub-pixel in row m−1 and column n+6, T(m−2, n+3) is the theoretical brightness value of the sub-pixel in row m−2 and column n+3, T(m−3, n) is the theoretical brightness value of the sub-pixel in row m−3 and column n, T(m−2, n−3) is the theoretical brightness value of the sub-pixel in row m−2 and column n−3, T(m−1, n−6) is the theoretical brightness value of the sub-pixel in row m−1 and column n−6, g>0, h>0, i>0, $p_i \leq 0$, 2g+2h+i=1, $$0 < \sum_{i=1}^{12} p_i \leqslant 0.4,$$

9<n≤Y−9 and 3<m<X−3.

FIGS. 20(1) to 20(4) illustrate several implementations of value matrices of $p_i$. It should be understood that, negative values in the matrices shown in FIG. 20 mean that a minus is added before $p_i$, which is equivalent to the subtraction of $p_i$ times the theoretical brightness value of the corresponding sub-pixel in formula (61). Taking FIG. 20(1) as an example, a value of $p_1$ corresponding to the sub-pixel in row G4 and column S1 is 0.02, a value of $p_2$ corresponding to the sub-pixel in row G5 and column S4 is 0.02, a value of $p_3$ corresponding to the sub-pixel in row G6 and column S7 is 0.02, a value of $p_4$ corresponding to the sub-pixel in row G7 and column S10 is 0.02, a value of $p_5$ corresponding to the sub-pixel in row G6 and column S13 is 0.02, a value of $p_6$ corresponding to the sub-pixel in row G5 and column S16 is 0.02, a value of $p_7$ corresponding to the sub-pixel in row G4 and column S19 is 0.02, a value of $p_8$ corresponding to the sub-pixel in row G3 and column S16 is 0.02, a value of $p_9$ corresponding to the sub-pixel in row G2 and column S13 is 0.02, a value of $p_{10}$ corresponding to the sub-pixel in row G1 and column S10 is 0.02, a value of $p_{11}$ corresponding to the sub-pixel in row G2 and column S4 is 0.02, and a value of $p_{12}$ corresponding to the sub-pixel in row G4 and column S1 is 0.02.

When calculating the actual brightness values of the middle sub-pixels (i.e., 9<n≤Y−9, 3<m≤X−3, sub-pixels from the fourth row to the fourth-last row and from the tenth column to the tenth-last column), the calculation may be performed by directly using the above formula (62). When calculating the actual brightness of the boundary sub-pixels, if the row number m of any one sub-pixel in the above formula (62) is equal to or smaller than zero, or larger than X, or the column number n of any one sub-pixel is larger than Y, the theoretical brightness value of the sub-pixel is set to be zero, and correspondingly, the correction factor corresponding to the theoretical brightness value is also zero. For example, when m=1 and 9<n≤Y−9, all of $p_8$, T(m−1, n+6), $p_9$, T(m−2, n+3), $p_{10}$, T(m−3, n), $p_{11}$, T(m−2, n−3), $p_{12}$ and T(m−1, n−6) are zero, and then the actual brightness values of sub-pixels from the tenth column to the ninth-last column in the first row may be calculated by using the following formula (63):

$$A(m, n) = g * T(m, n-6) + h * T(m, n-3) + \left(i + \sum_{i=1}^{7} q_i\right) * T(m, n) + h * T(m, n+3) + g * T(m, n+6) - [q_1 * T(m, n-9) + q_2 * T(m+1, n-6) + q_3 * T(m+2, n-3) + q_4 * T(m+3, n) + q_5 * T(m+2, n+3) + q_6 * T(m+1, n+3) + q_7 * T(m, n+9)] \quad (63)$$

wherein, $q_1$ corresponds to $p_1$, $q_2$ corresponds to $p_2$, $q_3$ corresponds to $p_3$, $q_4$ corresponds to $p_4$, $q_5$ corresponds to $p_5$, $q_6$ corresponds to $p_6$, $q_7$ corresponds to $p_7$ and $$0 < \sum_{i=1}^{7} q_i \leq 0.4.$$

Similarly, a person skilled in the art can derive formulae for calculating the actual brightness values of the other boundary sub-pixels based on the same method, which are not repeatedly described here.

It should be understood that, identical letters appearing in different implementations represent different correction factors. Moreover, correction factors in different implementations are independent. For example, $j_i$ in formula (24) and $j_i$ in formula (38) are independent from each other, and the value of $j_i$ in formula (24) is not influenced by $j_i$ in formula (38).

As another aspect of the present invention, there is provided a display panel, which comprises the pixel array provided by the present invention. It can be known from the above description that the display panel provided by the present invention has high aperture ratio, simple manufacture process and low granular sensation, and achieves a display effect of a display panel with higher resolution in the same size.

As still another aspect of the present invention, there is provided a display device, which comprises the above display panel provided by the present invention. The display device may be a mobile phone, a computer, or the like. The display device has both simple manufacture process and low granular sensation, and achieves a display effect of a display panel with higher resolution in the same size.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection range of the present invention.

The invention claimed is:

1. A driving method of a pixel array, wherein, the pixel array comprises a plurality of pixel units, each of which comprises three sub-pixels in different colors, in each pixel unit, any two adjacent sub-pixels are combined into a pixel block having a square shape, a width of each of the sub-pixels is a half of a length of each of the sub-pixels, and the driving method comprises steps of:

S1, calculating theoretical brightness values of an image to be displayed at respective sub-pixels;

S2, calculating actual brightness values of the respective sub-pixels, wherein, the actual brightness value of each sub-pixel at least comprises a sum of weighted theoretical brightness value of the sub-pixel and weighted theoretical brightness values of one or more sub-pixels in the same color as the sub-pixel in the same row; and S3, inputting signals to the respective sub-pixels, so that the respective sub-pixels reach the actual brightness values calculated in step S2, wherein, in step S2, the actual brightness value of each sub-pixel is calculated by subtracting weighted theoretical brightness values of six or more second sub-pixels from the sum of a part of the weighted theoretical brightness value of the sub-pixel to be calculated and weighted theoretical brightness values of two or more first sub-pixels, wherein each of the first sub-pixels and the second sub-pixels has the same color as the sub-pixel to be calculated, the first sub-pixels are in same row as the sub-pixel to be calculated, and the second sub-pixels are in different rows from the sub-pixel to be calculated, and wherein, the pixel array comprises X rows and Y columns of sub-pixels, X and Y are whole number, and in step S2, the actual brightness value A(m, n) of the sub-pixel in row m and column n is calculated according to the following formula:

$$A(m, n) = a * T(m, n-3) + \left(b + \sum_{i=1}^{6} f_i\right) * T(m, n) + a * T(m, n+3) - [f_1 * T(m-1, n-3) + f_2 * T(m-1, n+3) + f_3 * T(m+1, n-3) + f_4 * T(m+1, n+3) + f_5 * T(m-1, n) + f_6 * T(m+1, n)];$$

wherein, T(m, n) is the theoretical brightness value of the sub-pixel in row m and column n, m and n are whole number, T(m, n−3) is the theoretical brightness value of the sub-pixel in row m and column n−3, T(m, n+3) is the theoretical brightness value of the sub-pixel in row m and column n+3, T(m−1, n−3) is the theoretical brightness value of the sub-pixel in row m−1 and column n−3, T(m−1, n+3) is the theoretical brightness value of the sub-pixel in row m−1 and column n+3, T(m+1, n−3) is the theoretical brightness value of the sub-pixel in row m+1 and column n−3, T(m+1, n+3) is the theoretical brightness value of the sub-pixel in row m+1 and column n+3, T(m+1, n) is the theoretical brightness value of the sub-pixel in row m+1 and column n, T(m−1, n) is the theoretical brightness value of the sub-pixel in row m−1 and column n, $1<m<X$, $X \geq 3$, $3<n \leq Y-3$, $Y \geq 7$, $a>0$, $b>0$, $f_1>0$, $f_2>0$, $f_3>0$, $f_4>0$, $f_5>0$, $f_6>0$, $2a+b=1$, and $$\sum_{i=1}^{6} f_i \leq 0.4.$$

* * * * *